US012448660B2

(12) United States Patent
Ando et al.

(10) Patent No.: US 12,448,660 B2
(45) Date of Patent: Oct. 21, 2025

(54) HOT-ROLLED STEEL SHEET AND METHOD FOR MANUFACTURING SAME

(71) Applicant: NIPPON STEEL CORPORATION, Tokyo (JP)

(72) Inventors: Jun Ando, Tokyo (JP); Teruki Hayashida, Tokyo (JP); Tatsuo Yokoi, Tokyo (JP); Akifumi Sakakibara, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 734 days.

(21) Appl. No.: 17/787,857

(22) PCT Filed: Feb. 5, 2021

(86) PCT No.: PCT/JP2021/004305
§ 371 (c)(1),
(2) Date: Jun. 21, 2022

(87) PCT Pub. No.: WO2021/157692
PCT Pub. Date: Aug. 12, 2021

(65) Prior Publication Data

US 2023/0041990 A1 Feb. 9, 2023

(30) Foreign Application Priority Data

Feb. 6, 2020 (JP) ..... 2020-018844

(51) Int. Cl.
*C22C 38/02* (2006.01)
*C21D 8/02* (2006.01)
(Continued)

(52) U.S. Cl.
CPC ..... *C21D 8/0226* (2013.01); *C21D 8/0284* (2013.01); *C21D 9/46* (2013.01);
(Continued)

(58) Field of Classification Search
CPC ..... C22C 38/008; C22C 38/02; C22C 38/04; C22C 38/06; C22C 38/08; C22C 38/105;
(Continued)

(56) References Cited

U.S. PATENT DOCUMENTS

2015/0203949 A1 7/2015 Yokoi et al.
2020/0190621 A1 6/2020 Cobo et al.

FOREIGN PATENT DOCUMENTS

JP 2002-309343 A 10/2002
JP 2016-204690 A 12/2016
(Continued)

*Primary Examiner* — Lois L Zheng
(74) *Attorney, Agent, or Firm* — Birch, Stewart, Kolasch & Birch, LLP

(57) ABSTRACT

A hot-rolled steel sheet has, as a chemical composition, by mass %: C: 0.01% to 0.30%; Si: 0.01% to 3.00%; Mn: 0.20% to 3.00%; P: 0.030% or less; S: 0.030% or less; Al: 0.001% to 2.000%; N: 0.0100% or less; and Ni: 0.02% to 0.50%, in which among measurement points at which elemental analysis is performed at a measurement pitch of 1 μm using an EPMA in a region of 250 μm×250 μm on a surface, the percentage of measurement points having a Ni content of 0.5 mass % or more is 10% to 70%.

20 Claims, 1 Drawing Sheet

(51) Int. Cl.

| | |
|---|---|
| ***C21D 9/46*** | (2006.01) |
| ***C22C 38/00*** | (2006.01) |
| ***C22C 38/04*** | (2006.01) |
| ***C22C 38/06*** | (2006.01) |
| ***C22C 38/08*** | (2006.01) |

(52) U.S. Cl.
CPC ..... *C22C 38/001* (2013.01); *C22C 38/002* (2013.01); *C22C 38/02* (2013.01); *C22C 38/04* (2013.01); *C22C 38/06* (2013.01); *C22C 38/08* (2013.01)

(58) Field of Classification Search
CPC ..... C22C 38/12; C22C 38/14; C22C 38/16; C22C 38/42; C22C 38/48; C22C 38/50; C23C 22/12
See application file for complete search history.

(56) References Cited

FOREIGN PATENT DOCUMENTS

| | | | | |
|---|---|---|---|---|
| TW | 201837205 | A | 10/2018 | |
| WO | WO 2014/051005 | A1 | 4/2014 | |
| WO | WO-2014054141 | A1 * | 4/2014 | ..... B32B 15/013 |
| WO | WO 2018/220540 | A1 | 12/2018 | |

* cited by examiner

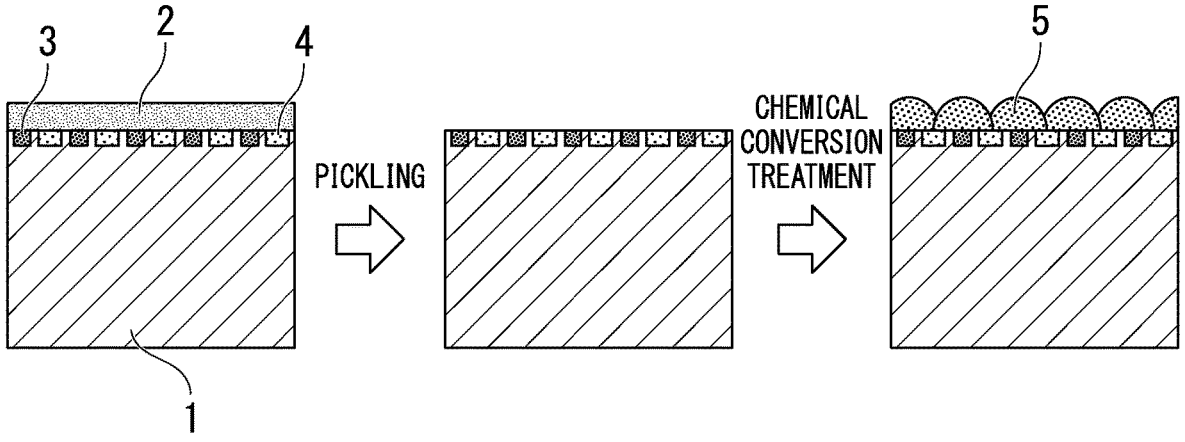
3
2
4
PICKLING
CHEMICAL
CONVERSION
TREATMENT
5
1

HOT-ROLLED STEEL SHEET AND METHOD FOR MANUFACTURING SAME

TECHNICAL FIELD OF THE INVENTION

The present invention relates to a hot-rolled steel sheet and a method for manufacturing the hot-rolled steel sheet.

Priority is claimed on Japanese Patent Application No. 2020-018844, filed on Feb. 6, 2020, the content of which is incorporated herein by reference.

BACKGROUND ART

In recent years, a weight reduction of a vehicle body by the use of a high strength steel sheet has been promoted in order to reduce the amount of carbon dioxide ($CO_2$) emissions from vehicles. In addition, in addition to mid steel sheets, high strength steel sheets have been frequently used for a vehicle body in order to ensure the safety of occupants. More recently, plug-in hybrid vehicles and electric vehicles are expected to increase due to stricter fuel consumption regulations and environmental regulations related to NOx and the like. For these next-generation vehicles, it is required to install a high capacity battery, and to further reduce the weight of the vehicle body weight.

In order to further reduce the weight of a vehicle body, it may be possible to replace steel sheets with lightweight materials such as an aluminum alloy, a resin, CFRP, and the like or to further increase the strength of steel sheets, and from the viewpoint of material cost and processing cost, it is realistic to use ultra-high strength steel sheets for mass-produced cars, excluding high-end cars.

For undercarriage components (for example, lower arms) in which hot-rolled steel sheets are primarily employed, high strength steel sheets having a tensile strength of 540 MPa or more (the tensile strength is 540 MPa or more) are applied in order to reduce the weight. Even in a case where the strength is high, the rigidity may be insufficient in a case where the sheet thickness is small. Therefore, changing the shape or structure of the components is considered to be a measure against insufficient rigidity, but in this case, the shape or structure of the components is made complicated. Therefore, high strength steel sheets which are applied to reduce the weight of a vehicle body are required to have a high strength and improved workability and fatigue properties.

For example. Patent Document 1 discloses a method for manufacturing a hot-rolled steel sheet having a high strength and excellent surface properties, formability (ductility, burring properties), and notch fatigue properties. In Patent Document 1, in order to suppress a tiger stripe-like scale pattern deteriorating the surface properties, the Si content is reduced, and a composite structure including polygonal ferrite precipitation hardened by Ti carbides and 1% to 10% of a low temperature transformed product is made to realize high ductility and burring properties.

In addition, Patent Document 2 discloses a high strength hot-rolled steel sheet having excellent ductility, fatigue properties, and corrosion resistance, and a method for manufacturing the high strength hot-rolled steel sheet. In Patent Document 2, the Si content is reduced in order to suppress a tiger stripe-like scale pattern deteriorating the surface properties. In addition, the size of Ti carbides is controlled so that the mass of those having a circle equivalent grain size of 7 nm or more and 20 nm or less is 50% or more of the total mass of the Ti carbides, whereby fatigue properties are improved. In addition, Patent Document 2 describes that the hot-rolled steel sheet has good chemical convertibility and post-coating corrosion resistance.

PRIOR ART DOCUMENT

Patent Document

[Patent Document 1] PCT International Publication No. WO2014/051005

[Patent Document 2] Japanese Unexamined Patent Application, First Publication No. 2016-204690

DISCLOSURE OF THE INVENTION

Problems to be Solved by the Invention

The alloying element content is usually increased in obtaining a high strength and good workability and fatigue properties, including Patent Documents 1 and 2 described above.

Even in such a high strength steel sheet having an increased alloying element content, for example, in a case where a chemical conversion treatment such as a zinc phosphate treatment is performed under ideal operating conditions, no problems occur in chemical convertibility in many cases. However, industrially, in a chemical conversion treatment for vehicle components and the like, a plurality of components are continuously subjected to the chemical conversion treatment using the same chemical conversion treatment liquid. In this case, the chemical conversion treatment liquid gradually deteriorates, and the chemical conversion treatment may not be performed under ideal operating conditions.

The inventors have conducted studies, and as a result, found that in a case where a high strength steel sheet (for example, having a tensile strength of 490 MPa or more) having a relatively large alloying element content is subjected to a chemical conversion treatment using a deteriorated chemical conversion treatment liquid, problems occur in that the chemical convertibility is not necessarily sufficient, transparency that is a part where the base metal sheet is exposed to the surface of the steel sheet after the chemical conversion treatment is generated, and the adhesion between a lacquer and the steel sheet deteriorates when the surface of the steel sheet is coated with the lacquer.

In a case where the chemical convertibility is reduced due to the use of the deteriorated chemical conversion treatment liquid, for example, it is required to take measures for strictly managing the management value of the free acidity, such as using a large amount of an accelerator which increases the chemical convertibility, among the operating conditions of the chemical conversion treatment, and this leads to an increase in manufacturing cost and a reduction in productivity. Therefore, in a case where good chemical convertibility can be obtained even in a high strength steel sheet even in a case where the chemical conversion treatment liquid deteriorates and the conditions of the chemical conversion treatment thus vary, that is, good post-coating corrosion resistance can be obtained under a wide range of the operating conditions of the chemical conversion treatment, it is not necessary to strictly manage the operating conditions of the chemical conversion treatment, and it is possible to prevent an increase in manufacturing cost and a reduction in productivity.

The present invention has been contrived in view of the above problems. An object of the present invention is to provide a hot-rolled steel sheet having excellent chemical convertibility and a method for manufacturing the hot-rolled steel sheet.

Means for Solving the Problem

The inventors have conducted studies on the reason for the reduction in chemical convertibility of a high strength steel sheet depending on the conditions. As a result, it is thought that oxides of Si, Al, and the like or concentrated layers of Mn, Cu, and the like are formed on a surface of the high strength steel sheet or a surface layer area near the surface even after pickling, and these inhibit the elution of Fe during the chemical conversion treatment, thereby reducing the chemical convertibility. The inventors have further conducted studies, and as a result, found that by partially concentrating (locally concentrating) Ni on the surface layer of the steel sheet, the elution of Fe is accelerated and the chemical convertibility is improved.

The present invention has been completed based on the above findings, and the gist thereof is the following hot-rolled steel sheet.

(1) A hot-rolled steel sheet according to an aspect of the present invention, having, as a chemical composition, by mass %: C: 0.01% to 0.30%; Si: 0.01% to 3.00%; Mn: 0.20% to 3.00%; P: 0,030% or less; S: 0.030% or less; Al: 0.001% to 2.000%; N: 0.0100% or less; Ni: 0.02% to 0.50%; Nb: 0% to 0.060%; V: 0% to 0.20%; Ti: 0% to 0.20%; Cu: 0% to 0.20%; Cr: 0% to 0.20%; Mo: 0% to 1.00%; B: 0% to 0.0020%; W: 0% to 0.50%; Mg: 0% to 0.010%; Ca: 0% to 0.0100%; REM: 0% to 0.0100%; O: 0% to 0.0100%; Zr: 0% to 0.500%; Co: 0% to 0.500%; Zn: 0% to 0.500%; Sn: 0% to 0.500%; and a remainder consisting of Fe and impurities, in which among measurement points at which elemental analysis is performed at a measurement pitch of 1 μm using an EPMA in a region of 250 μm×250 μm on a surface, a percentage of measurement points having a Ni content of 0.5 mass % or more is 10% to 70%.

(2) The hot-rolled steel sheet according to (1), in which the chemical composition may contains one or two or more selected from the group consisting of Nb: 0.003% to 0.060%, V: 0.01% to 0.20%, Ti: 0.01% to 0.20%, Cu: 0.01% to 0.20%, Cr: 0.01% to 0.20%, Mo: 0.01% to 1.00%, B: 0.0005% to 0.0020%, W: 0.01% to 0.50%, Mg: 0.001% to 0.010%, Ca: 0.0010% to 0.0100%, REM: 0.0010% to 0.0100%, and O: 0.0005% to 0.0100%.

(3) The hot-rolled steel sheet according to (2), in which the chemical composition may contain Si: 0.50% to 3.00%.

(4) The hot-rolled steel sheet according to (2), in which the chemical composition may contain Si: 0.01% or more and less than 0.50%, and Al: 0.050% to 2.000%.

(5) The hot-rolled steel sheet according to (2), in which the chemical composition may contain Si: 0.01% or more and less than 0.50%, and Al: 0.001% or more and less than 0.050%, and a total of Si and Al may be 0.50% or more and less than 0.55%.

(6) The hot-rolled steel sheet according to any one of (3) to (5), in which among the measurement points at which the elemental analysis is performed on the surface, the percentage of measurement points having an O content of 0.5 mass % or more may be 30% or less.

(7) The hot-rolled steel sheet according to any one of (1) to (6), in which the chemical composition may contain Cu: 0.01% to 0.20%, and Ni/Cu may be 0.50 or more.

(8) The hot-rolled steel sheet according to any one of (1) to (7), in which among the measurement points at which the elemental analysis is performed on the surface, the average interval between the measurement points having a Ni content of 0.5 mass % or more may be 3 to 10 μm.

(9) The hot-rolled steel sheet according to any one of (1) to (8), in which the surface may have a rust preventive oil film.

(10) The hot-rolled steel sheet according to any one of (1) to (8), in which the surface may have a chemical conversion film.

(11) A method for manufacturing a hot-rolled steel sheet according to another aspect of the present invention including: heating a steel piece having the chemical composition according to (1) or (2) in a heating furnace; descaling the heated steel piece; and hot-rolling the steel piece after the descaling to obtain a hot-rolled steel sheet, in which in the heating, after the surface temperature of the steel piece reaches 1,100° C. or higher, the steel piece is held for 60 minutes or longer under an atmosphere having an air ratio of 0.9 or more, and an extraction temperature is 1,180° C. or higher, and in the descaling, the steel piece of which the surface temperature is 1,170° C. or higher is descaled at least once with an injection pressure of 5 to 50 MPa, and the surface temperature of the steel piece is held at 1,100° C. or higher for 20 to 240 seconds after completion of the descaling.

Effects of the Invention

According to the aspects of the present invention, it is possible to obtain a hot-rolled steel sheet having excellent chemical convertibility and a method for manufacturing the hot-rolled steel sheet. In the hot-rolled steel sheet of the present invention, even in a case where the conditions of a chemical conversion treatment vary, a good chemical conversion film can be obtained.

BRIEF DESCRIPTION OF THE DRAWINGS

FIG. 1 is a diagram for illustrating a mechanism in which the formation of chemical conversion crystals is accelerated by Ni locally concentrated on a surface layer.

EMBODIMENTS OF THE INVENTION

Hereinafter, a hot-rolled steel sheet according to an embodiment of the present invention (hot-rolled steel sheet according to this embodiment) will be described.

The hot-rolled steel sheet according to this embodiment has a predetermined chemical composition, and among measurement points at which elemental analysis is performed at a measurement pitch of 1 μm using an EPMA in a region of 250 μm×250 μm on a surface, the percentage of measurement points having a Ni content of 0.5 mass % or more is 10% to 70%.

The hot-rolled steel sheet according to this embodiment may have a chemical conversion film and/or an electrodeposition coating film on the surface thereof. In addition, the hot-rolled steel sheet according to this embodiment may have a rust preventive oil film on the surface thereof.

<Chemical Composition>

Hereinafter, reasons for limiting the chemical composition will be described. "%" related to the chemical composition is by mass unless otherwise specified. In addition, in the following numerical limitation ranges with "to", values at both ends are included in principle as a lower limit and an upper limit. Numerical values expressed by "greater than" or "less than" are not included in the numerical range.

C: 0.01% to 0.30%

C is an element which contributes to high-strengthening of a steel sheet by structural strengthening by producing a low temperature transformed product, or by precipitation hardening by forming precipitates with Ti, Nb, and/or V in a case where Ti, Nb, and/or V is contained. In a case where the C content is less than 0.01%, it is not possible to obtain a strength of preferably 300 MPa or more, more preferably 490 MPa or more, and even more preferably 540 MPa or more as the strength required for the steel sheet. Therefore, the C content is 0.01% or more. The C content is preferably 0.03% or more, and more preferably 0.05% or more.

In a case where the C content is greater than 0.30%, the area ratio of the low temperature transformed product and cementite, which are hard layers, increases, and the workability is reduced. Therefore, the C content is 0.30% or less. The C content is preferably 0.25% or less, and more preferably 0.20% or less.

Si: 0.01% to 3.00%

Si is used as an element improving the strength, and is an important element for the formation of ferrite. In addition, Si is also an effective element for deoxidation. Therefore, the Si content is 0.01% or more. In a case where microstructure control for forming ferrite is used, the Si content is preferably 0.50% or more, and more preferably 0.80% or more.

In a case where the Si content increases, the ferrite temperature range expands to the high temperature side. In addition, regarding high temperature oxidation of steel, Si influences the growth rate and properties of scale. Si in a steel sheet forms $Fe_2SiO_4$ on a surface of the steel sheet during hot-rolling. In a case where the content is excessive, Si is concentrated on the surface of the steel sheet, and the concentrated layer cannot be completely removed even after pickling, which will affect the chemical convertibility. Therefore, the Si content is 3.00% or less. The Si content is preferably 2.50% or less, and more preferably 2.00% or less. The Si content may be less than 0.50% in a case where microstructure control for forming ferrite is not used.

Mn: 0.20% to 3.00%

Mn is an element which contributes to high-strengthening of a steel sheet by ferrite strengthening. In addition, in a case where the Mn content increases, the austenite temperature range expands to the low temperature side, and the two-phase temperature range of ferrite+austenite expands. In addition, Mn is an element having an effect of suppressing the hot cracking due to S by combining with S and fixing S as MnS. In order to obtain the above effects, the Mn content is 0.20% or more. In order to obtain a strength of preferably 300 MPa or more as a strength required for the steel sheet, the Mn content is preferably 0.30% or more. In order to obtain a strength of more preferably 490 MPa or more as a strength required for the steel sheet, the Mn content is more preferably 0.90% or more. In order to obtain a strength of even more preferably 540 MPa or more as a strength required for the steel sheet, the Mn content is even more preferably 1.20% or more.

In a case where the Mn content is greater than 3.00%, problems in manufacturing, such as the occurrence of cracks in slabs during casting, occur. Therefore, the Mn content is 3.00% or less. The Mn content is preferably 2.50% or less, and more preferably 2.00% or less.

P: 0.030% or less

The P content is preferably small. In a case where the P content is greater than 0.030%, segregation of P leading to crystal granulation is remarkable, and thus the local ductility deteriorates due to grain boundary embrittlement. Therefore, the P content is 0.030% or less. The P content is preferably 0.020% or less, and more preferably 0.015% or less.

The P content may be 0%. However, in a case where the P content is less than 0.005%, the cost significantly increases. Therefore, the lower limit of the P content may be 0.005%.

S: 0.030% v or less

The S content is preferably small. In a case where the S content is greater than 0.030%, adverse effects on the weldability, manufacturability during casting or hot-rolling, and hole expansibility increase. Therefore, the S content is 0.030% or less. The S content is preferably 0.015% or less, and more preferably 0.010% or less.

The S content may be 0%. However, in a case where the S content is less than 0.002%, the cost significantly increases. Therefore, the lower limit of the S content may be 0.002%.

Al: 0.001% to 2.000%

Al is an element related to deoxidation and the formation of ferrite like Si. In addition, in a case where the Al content increases, the ferrite temperature range expands to the high temperature side. In addition, Al is an element which suppresses the formation of coarse cementite and contributes to the improvement of hole expansibility. Therefore, the Al content is 0.001% or more. The Al content is preferably 0.020% or more, and more preferably 0.030% or more. In addition, in a case where microstructure control for forming ferrite is used, the Al content is preferably 0.050% or more.

In a case where the Al content is greater than 2.000%, the number of Al-based coarse inclusions is increased. In addition, the workability deteriorates or surface defects are generated. In addition, a nozzle of a tundish during casting is likely to be blocked. Therefore, the Al content is 2.000% or less. The Al content is preferably 1.200% or less, more preferably 1.000% or less, and even more preferably 0.400% or less. The Al content may be less than 0.050% in a case where microstructure control for forming ferrite is not used.

N: 0.0100% or less

N is an element which reduces ductility in a case where it remains in steel as solid solution nitrogen. In addition, N combines with Ti and forms TiN. In a case where the N content is large, coarse TiN precipitates, and the hole expansibility deteriorates. Therefore, the N content is preferably small. In a case where the N content is greater than 0.0100%, the above-described adverse effects are remarkably exhibited. Therefore, the N content is 0.0100% or less. The N content is preferably 0.0060% or less, and more preferably 0.0040% or less. The N content may be 0%. However, in a case where the N content is less than 0.0010%, the cost significantly increases. Therefore, the lower limit of the N content may be 0.0010%.

Ni: 0.02% to 0.50%

Ni is the most important element for the hot-rolled steel sheet according to this embodiment. In the manufacturing of a hot-rolled steel sheet, primarily, in a heating step of heating a steel piece as a source of a hot-rolled steel sheet in a heating furnace and in a descaling step of descaling the heated steel piece, Ni is locally concentrated on the surface layer side of the steel sheet near the interface between the surface of the steel sheet and the scale under specific operating conditions. In a case where a chemical conversion treatment such as a zinc phosphate treatment is performed on the surface of the steel sheet, a difference occurs in ionization tendency between the region where Ni is concentrated and the region therearound where Ni is not concentrated. As a result, Fe around Ni locally concentrated is eluted to the surface of the steel sheet, and acts as precipitation nuclei of a chemical conversion film (chemical conversion coating), and a film in which the size of chemical conversion crystals is small is formed without the generation of transparency. Thus, it is possible to improve the adhesion between the lacquer and the steel sheet.

In a case where the Ni content is less than 0.02%, since the above effects cannot be obtained (transparency is generated or the size of chemical conversion crystals is increased), the Ni content is 0.02% or more. For example, in a case where the Ni content is less than 0.02%, the local concentration of Ni does not occur. Thus, iron elution into the chemical conversion bath is not accelerated, the size of chemical conversion crystals is increased, and the coating adhesion deteriorates. The Ni content is preferably 0.05% or more.

In a case where the Ni content is greater than 0.50%, Ni covers the entire surface of the steel sheet (not local concentration), and thus the above effects cannot be obtained. In addition, the cost increases. Therefore, the Ni content is 0.50% or less. The Ni content is preferably 0.45% or less, and more preferably 0.40% or less.

Basically, the hot-rolled steel sheet according to this embodiment contains the above-described elements with a remainder consisting of Fe and impurities. However, the hot-rolled steel sheet may contain the following elements within an amount to be described later. The following elements are optional elements which are not necessarily contained, and may not be contained.

Cu: 0% to 0.20%

Cu is an element which contributes to an increase in strength of the steel sheet. Therefore, Cu may be contained. In order to contribute to an increase in strength, the Cu content is preferably 0.01% or more. The Cu content is preferably 0.02% or more, and more preferably 0.04% or more.

Cu has a low melting point, and is concentrated at the interface between the scale and the base metal sheet through austenite grain boundaries. In a case where the Cu content is large, a Cu concentrated layer is formed, and the zinc phosphate treatability is reduced. In a case where the Cu content is greater than 0.20%, a Cu concentrated layer covers the entire surface of the steel sheet, and thus the chemical convertibility significantly deteriorates. Therefore, the Cu content is 0.20% or less. The Cu content is preferably 0.15% or less, and more preferably 0.10% or less. In addition, in a case of Ni/Cu<0.50, a Cu concentrated layer is likely to be uniformly formed on the entire surface of the steel sheet, and thus the chemical convertibility deteriorates. Thus, Ni/Cu≥0.50 is preferable.

Nb: 0% to 0.060%

V: 0% to 0.20%

Ti: 0% to 0.20%

Cr: 0% to 0.20%

Mo: 0% to 1.00%

W: 0% to 0.50%

Nb, V, Ti, Cr, Mo, Nb, and W are elements which increase the strength of the steel sheet by precipitation hardening and/or solid solution strengthening. Therefore, these may be contained. In a case where the above effects are obtained, the Nb content is preferably 0.003% or more, more preferably 0.005% or more, even more preferably 0.010% or more, and still more preferably 0.015% or more. In addition, the V content is preferably 0.01% or more. The Ti content is preferably 0.01% or more, more preferably 0.05% or more, even more preferably 0.10% or more, and still more preferably 0.15% or more. The Cr content is preferably 0.01% or more, more preferably 0.05% or more, and even more preferably 0.10% or more. The Mo content is preferably 0.01% or more, and more preferably 0.02% or more. The W content is preferably 0.01% or more, and more preferably 0.02% or more.

In a case where the Nb content is greater than 0.060%, the V content is greater than 0.20%, the Ti content is greater than 0.20%, the Cr content is greater than 0.20%, the Mo content is greater than 1.00%, and the W content is greater than 0.50%, the above effects are saturated, and the economic efficiency is reduced. Therefore, in a case where Nb, V, Ti, Cr, Mo, and W are contained, the Nb content is 0.060% or less, the V content is 0.20% or less, the Ti content is 0.20% or less, the Cr content is 0.20% or less, the Mo content is 1.00% or less, and the W content is 0.50% or less. The Nb content is preferably 0.055% or less, and more preferably 0.050% or less. The V content is preferably 0.15% or less, and more preferably 0.08% or less. The Ti content is preferably 0.18% or less, and more preferably 0.17% or less. The Cr content is preferably 0.18% or less, and more preferably 0.15% or less. The Mo content is preferably 0.70% or less, and more preferably 0.05% or less. The W content is preferably 0.40% or less, and more preferably 0.03% or less.

B: 0% to 0.0020%

B is an element having an effect of improving hardenability, thereby increasing the fraction of a low temperature transformed product phase. Therefore, in a case where it is desired to exhibit the hardenability improving effect, 0.0005% or more of B may be contained. The B content is preferably 0.0010% or more, and preferably 0.0015% or more.

In a case where the B content is greater than 0.0020%, the effect is saturated, and there is an increased concern that cracks occur in slabs in a cooling step after continuous casting. Therefore, in a case where B is contained, the B content is 0.0020% or less.

Mg: 0% to 0.010%

Ca: 0% to 0.0100%

REM: 0% to 0.0100%

Mg, Ca, and REM are elements which control the morphology of non-metal inclusions which are fracture origins, causing the deterioration of workability, and improve the workability. Therefore, Mg, Ca, and REM may be contained. In a case where the above effects are obtained, the Mg content is preferably 0.001% or more, the Ca content is preferably 0.0010% or more, and the REM content is preferably 0.0010% or more.

In a case where the Mg content is greater than 0.010%, the Ca content is greater than 0.0100%, and the REM content is greater than 0.0100%, the above effects are saturated, and the economic efficiency is reduced. Therefore, in a case where Mg, Ca, and REM are contained, the Mg content is 0.010% or less, the Ca content is 0.0100% or less, and the REM content is 0.0100% or less. The Mg content is preferably 0.005% or less, the Ca content is preferably 0.0070% or less, and the REM content is preferably 0.0070% v or less.

O: 0% to 0.0100%

O is an element which disperses a large number of fine oxides during deoxidation of molten steel. Therefore, O may be contained. In a case where the above effect is obtained, the O content is preferably 0.0005% or more. The O content is preferably 0.0010% or more, and more preferably 0.0020% or more.

O is an element which forms coarse oxides which are fracture origins in steel in a case where the content thereof is too large, thereby causing brittle fracture or hydrogen-induced cracks. Therefore, the O content is 0.0100% or less. From the viewpoint of weldability, the O content is preferably 0.0030% or less.

Zr: 0% to 0.500%

Co: 0% to 0.500%

Zn: 0% to 0.500%

Sn: 0% to 0.500%

Even in a case where Zr, Co, Zn, or Sn is contained in an amount of 0.500% or less, the effects of the hot-rolled steel sheet according to this embodiment are not impaired. Therefore, one or more of Zr, Co, Zn, and Sn may be contained in an amount of 0.500% or less, respectively.

The amount of each element in the hot-rolled steel sheet according to this embodiment (including a case where a chemical conversion film or a rust preventive oil film is provided on the surface) is the average content in the total sheet thickness, obtained by ICP emission spectroscopic analysis using chips according to JIS G 1201: 2014. The C content and the S content are obtained by a known high-frequency combustion method (combustion-infrared absorption method). The O content is obtained using a known inert gas fusion-nondispersive infrared absorption method.

<Among Measurement Points at which Elemental Analysis is Performed at Measurement Pitch of 1 μm Using EPMA in Region of 250 μm×250 μm on Surface, Percentage of Measurement Points Having Ni Content of 0.5 mass % or More is 10% to 70%>

The inventors have conducted studies on the reason for the reduction in chemical convertibility of a high strength steel sheet. As a result, it is thought that oxides of Si, Al, and the like or concentrated layers of Mn, Cu, and the like are formed on a surface or a surface layer area of the high strength steel sheet even after pickling, and these inhibit the elation of Fe during the chemical conversion treatment, thereby reducing the chemical convertibility particularly in a state in which the conditions of the chemical conversion treatment have deteriorated due to the variation during the operation.

Regarding this, Ni is partially (not the entire surface) concentrated on the surface layer of the steel sheet to generate a potential difference between Ni and Fe, and the elution of Fe around the Ni-concentrated layer is accelerated. That is, Ni remains, and regions therearound elute and form precipitation nuclei of the chemical conversion film. Thus, a film in which the size of chemical conversion crystals is small is formed without the generation of transparency, and the chemical convertibility is improved. For example, it is thought that this is because, as shown in FIG. 1, due to Ni-concentrated layers 4 formed on a surface of a steel sheet (although FIG. 1 shows a case where oxides of Si, Al, and the like or concentrated layers 3 of Mn, Cu, and the like remain, regardless of the presence or absence of the oxides or concentrated layers), a potential difference is generated between Ni locally concentrated and a base metal sheet 1 on the surface, precipitation nuclei of chemical conversion crystals 5 crystallize from the parts where the potential difference is generated, and the formation of the chemical conversion crystals 5 is accelerated. The base metal sheet 1 refers to a steel sheet part excluding scale 2.

Specifically, in a case where among measurement points at which elemental analysis is performed at a measurement pitch of 1 μm using an EPMA in a region of 250 μm×250 μm on the surface, the percentage of measurement points having a Ni content of 0.5 mass % or more is 10% to 70%, the chemical convertibility is improved.

In a case where the percentage of measurement points having a Ni content of 0.5 mass % or more is less than 10%, the effect of accelerating the elution of Fe is not sufficient, and the chemical convertibility is not sufficiently improved.

In addition, in a case where the percentage of measurement points having a Ni content of 0.5 mass % or more is greater than 70%, Ni almost uniformly exists on the surface of the steel sheet, and the above effects cannot be sufficiently obtained.

In a case where the hot-rolled steel sheet according to this embodiment has a chemical conversion film (including a case where an electrodeposition coating film is provided by further electrodeposition coating), it may be difficult to perform the elemental analysis on the surface of the hot-rolled steel sheet. In this case, in a case where among measurement points at which elemental analysis is performed at a measurement pitch of 1 μm using an EPMA in a rectangular region that is 10 μm in the sheet thickness direction from the surface of the steel sheet and is 500 μm in the sheet width direction in a cross-section in the sheet thickness direction, the percentage of measurement points having a Ni content of 0.5 mass % or more is 10% to 70%, among measurement points at which elemental analysis is performed at a measurement pitch of 1 μm using an EPMA in a region of 250 μm×250 μm on the surface, the percentage of measurement points having a Ni content of 0.5 mass % or more may be regarded to be 10% to 70%. This is because Ni shows a substantially three-dimensionally isotropic distribution in a range of 10 μm (surface layer area) in the sheet thickness direction from the surface.

The measurement points having a Ni content of 0.5 mass % or more are preferably distributed in a patchy manner on the surface of the steel sheet.

Specifically, the average interval between the regions having a Ni content of 0.5 mass % or more is preferably 3 to 10 μm. In a case where the average interval is less than 3 μm or more than 10 μm, the elution of Fe around the Ni-concentrated portion is less likely to be accelerated.

The average interval between the regions having a Ni content of 0.5 mass % or more is measured as follows. An average of intervals between the adjacent measurement points having a Ni content of 0.5 mass % or more among the measurement points at which elemental analysis is performed at a measurement pitch of 1 μm using an EPMA in a region of 250 μm×250 μm on the surface of the hot-rolled steel sheet is defined as an average interval between the regions having a Ni content of 0.5 mass % or more.

In many cases, the hot-rolled steel sheet is pickled before the chemical conversion treatment, but in the hot-rolled steel sheet according to this embodiment, Ni is locally concentrated as described above even after pickling under normal pickling conditions (for example, for 30 to 60 seconds using a 1 to 10 wt % (weight %) hydrochloric acid solution at a temperature of 20° C. to 95° C.). Therefore, the chemical convertibility is excellent even after pickling.

In addition, the hot-rolled steel sheet according to this embodiment may have a rust preventive oil film formed on the surface in order to prevent oxidation and the like after pickling and before the chemical conversion treatment is started.

The measurement conditions in performing the elemental analysis at a measurement pitch of 1 μm using an EPMA in a region of 250 μm×250 μm on the surface and in obtaining the average interval between the regions having a Ni content of 0.5 mass % or more are, for example, as follows.

The measurement is performed using a tungsten electron gun type instrument of JEOL Ltd. (model number: JXA-8800RL) under conditions of an acceleration voltage of 15 kV, an irradiation current of 6×10& A, an irradiation time of 15 ms, and a beam diameter of 0.5 μm.

The same conditions may be applied also in a case where the elemental analysis is performed on the cross-section in the sheet thickness direction at a measurement pitch of 1 μm using an EPMA.

The chemical convertibility improvement effect in the hot-rolled steel sheet according to this embodiment generated by the local concentration of Ni is effective for any steel sheet.

However, in a steel sheet which contains a large amount of Si and Al in order to increase the strength or improve the formability, a large amount of oxides of Si and Al is formed on the surface of the steel sheet, and thus the chemical convertibility is reduced. Therefore, for example, 1) in a case where the Si content is 0.50% or more,
2) in a case where the Al content is 0.050% or more even with a Si content of less than 0.50%, or
3) in a case where the total content of Si and Al is 0.50% or more even with a Si content of less than 0.50% and an Al content of less than 0.050%.

the chemical convertibility improvement effect is particularly large.

Even in a case where the hot-rolled steel sheet according to this embodiment is subjected to the chemical conversion treatment and the electrodeposition coating, the above-described aspect in which Ni is locally concentrated rarely changes. That is, the distribution of the regions having a Ni content of 0.5 mass % or more near the boundary between the chemical conversion film and the hot-rolled steel sheet (corresponding to the vicinity of the surface of the hot-rolled steel sheet which is an original sheet) in the hot-rolled steel sheet subjected to the chemical conversion treatment is the same as the surface of the hot-rolled steel sheet which is an original sheet. Therefore, the measurement result obtained by the following method can be regarded as the percentage of measurement points having a Ni content of 0.5 mass % or more (synonymous with the result of the measurement performed on the surface of the hot-rolled steel sheet) on the surface of the hot-rolled steel sheet which is an original sheet before the chemical conversion treatment.

<Among Measurement Points at which Elemental Analysis is Performed, Percentage of Measurement Points Having Oxygen (O) Content of 0.5 Mass % or More is 30% or Less>

In the hot-rolled steel sheet according to this embodiment, among measurement points at which elemental analysis is performed, the percentage of measurement points having an oxygen content of 0.5 mass % or more is preferably 30% or less.

In performing the elemental analysis, oxides of Si and Al are formed at the measurement points having an oxygen content of 0.5 mass % or more, and the fact that the percentage of these measurement points is 30% or less shows that the amount of oxides of Si, Al, and the like formed is small. Oxides reduce the chemical convertibility by inhibiting the elution of Fe during the chemical conversion treatment. Therefore, in a case where the amount of oxides is small, a film in which the size of chemical conversion crystals is small is formed without the generation of transparency, and the chemical convertibility is further improved.

In a case where the elemental analysis is performed, EPMA analysis targeted at an element having an atomic number equal to or more than that of boron (B) is performed in a region of 250 μm×250 μm at a measurement pitch of 1 μm. The percentage of measurement points having a Ni content of 0.5 mass % or more when the total mass of the element having an atomic number equal to or more than that of B is 100% is obtained.

In the EPMA analysis performed on a steel sheet, in a case where a rust preventive oil film is formed on the surface of the steel sheet, the rust preventive oil film is removed using a solvent such as acetone or alcohol so that the measurement can be performed on the surface of the steel sheet. In a case where scale is formed, the measurement is performed after pickling is performed under normal pickling conditions (for example, for 30 to 60 seconds using a 1 to 10 wt % (weight %) hydrochloric acid solution at a temperature of 20° C. to 95° C.).

The EPMA analysis is performed using a tungsten electron gun type instrument of JEOL Ltd. (model number: JXA-8800RL) under conditions of an acceleration voltage of 15 kV, an irradiation current of $6\times10^{-8}$ A, an irradiation time of 15 ms, and a beam diameter of 0.5 μm.

The structure (microstructure) of the hot-rolled steel sheet according to this embodiment is not limited. Regardless of the phase of the structure, the chemical convertibility is improved by the local concentration of Ni.

In addition, the chemical convertibility improvement effect generated by the local concentration of Ni is large in a high strength steel sheet containing a large amount of alloying elements. For example, the effect is clearly seen in a hot-rolled steel sheet having a tensile strength of 300 MPa or more, large in a hot-rolled steel sheet having a tensile strength of 490 MPa or more, and larger in a hot-rolled steel sheet having a tensile strength of 540 MPa or more.

The sheet thickness of the hot-rolled steel sheet according to this embodiment is not limited, and is, for example, 1.2 to 10.0 mm.

Hereinafter, a method for manufacturing the hot-rolled steel sheet according to this embodiment will be described.

The hot-rolled steel sheet according to this embodiment can be manufactured by a manufacturing method having the following steps.

(i) a heating step of heating a steel piece in a heating furnace
(ii) a descaling step of descaling the heated steel piece
(iii) a hot-rolling step of hot-rolling the steel piece after the descaling step to obtain a hot-rolled steel sheet The respective steps will be described.

A casting step (steel piece manufacturing step) which is performed prior to hot-rolling is not particularly limited. That is, following the melting by a blast furnace, an electric furnace, or the like, various secondary smelting may be performed to adjust the components as described above, and then casting may be performed by normal continuous casting or casting by an ingot method.

As a raw material, a scrap may be used.

[Heating Step]

[Descaling Step]

In the heating step, a steel piece such as a slab is heated in a heating furnace. Then, descaling is performed before the process reaches the hot-rolling step. The local concentration of Ni is achieved primarily in the heating step and the descaling step.

Specifically, by accelerating the oxidation of a surface of the steel piece in the heating step and selectively oxidizing Fe, Ni which is less likely to be oxidized than Fe is concentrated on the base metal sheet side of the interface between the scale and the base metal sheet. Then, oxides preferentially formed are removed to some extent by performing descaling, and the steel piece is held for a certain period of time or longer in a predetermined temperature range to further locally concentrate Ni.

In the heating step, after the surface temperature of the steel piece reaches 1,100° C. or higher, the steel piece is held for 60 minutes or longer under an atmosphere having an air ratio of 0.9 or more, and an extraction temperature is 1,180° C. or higher.

In order to form a sufficient Ni-concentrated layer on the surface layer in the heating furnace, it is necessary to accelerate the growth of scale of the steel piece. In a case where the air ratio in the heating furnace is less than 0.9, the growth of scale is along the parabolic rule, but slows down during a limited time in the heating furnace. Therefore, it is not possible to form a sufficient Ni-concentrated layer at the interface between the scale and the base metal sheet. The air ratio may vary depending on the position in the heating furnace or the change over time during the period in which the steel piece is heated. It is preferable that the minimum value of the air ratio at each position in the heating furnace during the period in which the steel piece is heated is 0.9 or more since the air ratio is 0.9 or more in a case where the steel piece is heated.

In a case where the air ratio is greater than 1.5, the yield increases with an increase in scale-off amount, and the heat loss due to an increase in exhaust gas amount increases. Whereby, the thermal efficiency deteriorates, and the production cost increases. Therefore, the air ratio is preferably 1.5 or less. The air ratio may vary depending on the position in the heating furnace or the change over time during the period in which the steel piece is heated. It is preferable that the maximum value of the air ratio at each position in the heating furnace during the period in which the steel piece is heated is 1.5 or less since the air ratio is 1.5 or less in a case where the steel piece is heated.

In addition, in a case where the holding time in a case where the surface temperature of the steel piece is 1,100° C. or higher is shorter than 60 minutes, the scale does not grow, and a sufficient Ni-concentrated layer cannot be formed at the interface between the scale and the base metal sheet.

It is not preferable that the holding time is longer than 240 minutes since the scale-off amount increases, and the yield is thus reduced. Moreover, the surface layer of the steel sheet is decarburized, and there is concern that the characteristics of the steel sheet deteriorate.

The extraction temperature is required to be 1,180° C. or higher in order to secure the surface temperature of the steel piece in the descaling step which is performed after the heating step. In a case where the interval time from the heating step to the descaling step is long, the extraction temperature may be raised to 1,200° C. or higher to secure the surface temperature of the steel piece.

In this embodiment, the extraction temperature is a lower one out of a temperature calculated at a position 5 mm away from the upper surface of the steel piece in the thickness direction of the steel piece and a temperature calculated at a position 5 mm away from the lower surface of the steel piece in the thickness direction of the steel piece in a case where the heat transfer calculation is performed by dividing the steel piece in the thickness direction from the atmospheric temperature of the heating furnace.

In the descaling step, the steel piece having a surface temperature of 1,170° C. or higher is descaled at least once with an injection pressure of 5 to 50 MPa. In addition, the surface temperature of the steel piece is held at 1,100° C. or higher for 20 to 240 seconds from the completion of the descaling.

In the descaling step, the scale layer formed until the heating step is removed. The scale layer exists in a state in which a Fe oxide and oxides of other elements are mixed. The scale layer is generally in a molten state in a temperature range of 1,170° C. or higher, but is in a solidified and firm state in a temperature range of less than 1,170° C., and thus it is difficult to remove it by descaling. In particular, in a case where the scale contains Si, a composite oxide of $Fe_2SiO_4$ exists at the same time as the Fe oxide, enters between the Fe oxides, and thus forms firm scale after solidification. Therefore, in the method for manufacturing the hot-rolled steel sheet according to this embodiment, descaling is performed at least once in a state in which the temperature of the steel piece is 1,170° C. or higher. However, in a case where the injection pressure in the descaling is less than 5 MPa, the scale cannot be sufficiently removed. In addition, in a case where the injection pressure in the descaling is greater than 50 MPa, Ni concentrated near the interface during heating is also removed. Therefore, the injection pressure is 5 to 50 MPa.

The descaling is preferably performed with an injection force of 50 to 700 MN/(m·s) per unit time and unit width. The injection force per unit time and unit width is obtained by the product of a descaling pressure (MPa), a descaling time (seconds), and a sheet length (in) of the steel sheet as a descaling target.

After the descaling is performed, the surface temperature of the steel piece is held at 1,100° C. or higher for 20 to 240 seconds from the completion of the descaling (primary descaling). By holding the temperature at 1,100° C. or higher for 20 seconds or longer, the surface of the steel sheet is oxidized again, and Ni is further concentrated at the interface.

In a case where the holding time at 1,100° C. or higher is shorter than 20 seconds, the concentration of Ni is not sufficient. Therefore, the holding time is 20 seconds or longer. The holding time is preferably 30 seconds or longer.

In a case where the holding time after the descaling is longer than 240 seconds, the thickness of the scale increases. Accordingly, the chemical convertibility is reduced, and the productivity is reduced. Therefore, the holding time is 240 seconds or shorter. The holding time is preferably 180 seconds or shorter.

After the surface temperature of the steel piece is held at 1,100° C. or higher, the steel piece is rolled.

After the surface temperature of the steel piece is held at 1,100° C. or higher for 20 to 240 seconds from the completion of the descaling, secondary descaling may be performed once or more on the steel piece in addition to the previous descaling (primary descaling). With the secondary descaling, the scale layer formed during holding can be removed. However, even in a case where the secondary descaling is performed so that the concentrated Ni is not removed, the injection pressure is 5 to 50 MPa as in the primary descaling. The surface temperature of the steel piece before the secondary descaling may be in a state in which the temperature of the steel piece is 1,170° C. or higher, or in a state in which the temperature of the steel piece is lower than 1,170° C.

The time for holding the surface temperature of the steel piece at 1,100° C. or higher from the completion of the secondary descaling may be between 20 and 240 seconds, or may be shorter than 20 seconds.

In a case where the time for holding the surface temperature of the steel piece at 1,100° C. or higher from the completion of the secondary descaling is longer than 240 seconds, the thickness of the scale increases. Accordingly, the chemical convertibility is reduced, and the productivity is reduced.

As described above, regarding the secondary descaling, the temperature before descaling and the time for holding the temperature at 1,100° C. or higher after descaling are not limited. However, in a case where the secondary descaling is performed once or more with a surface temperature of the steel piece of 1,170° C. or higher, and the surface temperature of the steel piece is held at 1,100° C. or higher for 20 to 240 seconds from the completion of the secondary descaling, the time for holding the surface temperature of the steel piece at 1,100° C. or higher from the completion of the primary descaling may be within 20 seconds.

In this way, regardless of whether only the primary descaling is performed or both the primary descaling and the secondary descaling are performed, the surface temperature of the steel piece may be held at 1,100° C. or higher for a total of 20 seconds or longer from the completion of the descaling. In view of the characteristics, in a case where a plurality of times of descaling and subsequent holding at 1,100° C. or higher are repeatedly performed, the holding time in any one or more times of holding is preferably 20 seconds or longer.

[Hot-Rolling Step]

The hot-rolling conditions in the hot-rolling step which is performed after the descaling step are not particularly limited. The hot-rolling conditions may be appropriately adjusted according to the sheet thickness and mechanical characteristics to be required. There are no restrictions on the cooling conditions after rolling. The steel piece may be cooled to room temperature (up to 100° C. or lower). Otherwise, it may be wound without cooling and air cooled in a state of a coil.

According to the above manufacturing method, it is possible to manufacture the hot-rolled steel sheet according to this embodiment.

EXAMPLES

Hereinafter, the present invention will be described in greater detail with examples, but is not limited to these examples.

Slabs having a chemical composition shown in Tables 1A to 1C were heated under the heating conditions shown in Tables 2A to 2C, and descaled under the descaling conditions shown in Tables 2A to 2C.

In the heating conditions, as described above, combustion control was carried out so that the minimum value of the air ratio at each position in a heating furnace and the maximum value of the air ratio at each position in the heating furnace were as shown in Tables 2A to 2C.

As a descaling condition, only primary descaling was performed on Steels 2, 34, 42 to 72, 75 to 82, and 86. Tables 2A to 2C show the surface temperature of the steel piece before primary descaling, and the pressure and injection force per unit time and unit width in the primary descaling. In addition, the time for holding the surface temperature of the steel piece after completion of the primary descaling at 1,100° C. or higher was shown as a condition in Tables 2A to 2C. The minimum surface temperature of the steel piece during the period of time from the completion of the primary descaling to the rolling of the steel piece was described in Tables 2A to 2C.

Steels 1, 3 to 33, 35 to 41, 73, 74, 83 to 85, 87, and 88 were subjected to primary descaling, and then subjected to secondary descaling. Tables 2A to 2C show the surface temperature of the steel piece before primary descaling, the pressure and injection force per unit time and unit width in the primary descaling, and the pressure and injection force per unit time and unit width in the secondary descaling (in those subjected to the secondary descaling, the pressure is described in the column of pressure of the secondary descaling). In a case where the secondary descaling was performed, a longer one out of the time for holding the surface temperature of the steel piece after completion of the primary descaling at 1,100° C. or higher and the time for holding the surface temperature of the steel piece after completion of the secondary descaling at 1,100° C. or higher, and a total holding time at 1,100° C. or higher after descaling were shown as conditions in Tables 2A to 2C. In addition, regarding the descaling in which the surface temperature of the steel piece after completion of the descaling was held at 1,100° C. or higher for a longer time out of the primary descaling and the secondary descaling, the minimum surface temperature of the steel piece during the period of time from the completion of the above descaling to the rolling of the steel piece was described in Tables 2A to 2C.

After the descaling, finish rolling was performed with a rolling finishing temperature set to 800° C. or higher. After the hot finish rolling, a part of the steels was cooled to 100° C. or lower, and another part was wound without cooling and air cooled in a state of a coil.

TABLE 1A

| | Chemical Composition (mass %, remainder: Fe and impurities) | | | | | | | | | | | | | | | |
|---|---|---|---|---|---|---|---|---|---|---|---|---|---|---|---|---|
| Steel | C | Si | Mb | P | 5 | Al | N | Ni | Nb | V | Ti | Cu | Cr | Mo | B | W |
| 1 | 0.03 | 0.01 | 1.27 | 0.008 | 0.008 | 0.239 | 0.0046 | 0.02 | 0.018 | — | 0:17 | 0.01 | — | — | — | — |
| 2 | 0.06 | 0.01 | 1.37 | 0.008 | 0.006 | 0.268 | 0.0055 | 0:06 | 0.019 | — | 0.16 | 0.02 | — | — | — | — |
| 3 | 0.05 | 0.84 | 1.45 | 0.010 | 0.012 | 0.030 | 0.0026 | 0.02 | — | — | — | 0.01 | — | — | — | — |
| 4 | 0.05 | 0.57 | 1.77 | 0.018 | 0.012 | 0.024 | 0.0014 | 0:09 | — | — | — | 0.06 | — | — | — | — |
| 5 | 0.19 | 0.48 | 1.77 | 0.010 | 0.007 | 0.360 | 0.0037 | 0:02 | — | — | — | 0.01 | — | — | — | — |
| 6 | 0.15 | 0.46 | 148 | 0.012 | 0.002 | 0.500 | 0.0015 | 0.08 | — | — | — | 004 | — | — | — | — |
| 7 | 0:17 | 1.80 | 1.66 | 0.026 | 0.009 | 0.500 | 0.0030 | 0.49 | — | — | — | 0 01 | — | — | — | — |
| 8 | 0.16 | 1.12 | 1.51 | 0.007 | 0.003 | 0.036 | 0.0028 | 0.06 | — | — | — | 0 12 | — | — | — | — |
| 9 | 016 | 1.31 | 2.26 | 0:026 | 0.003 | 0.904 | 0:0032 | 0.06 | — | — | — | 0.12 | — | — | — | — |
| 10 | 0.23 | 2.98 | 2.24 | 0.006 | 0.005 | 0.036 | 0.0030 | 0.06 | — | — | — | 0.01 | — | — | — | — |
| 11 | 0.09 | 0.05 | 2.92 | 0.010 | 0.001 | 1.990 | 0.0040 | 0.07 | — | — | — | 0.01 | — | — | — | — |
| 12 | 0.16 | 1.92 | 2.00 | 0.014 | 0.003 | 1.050 | 0.0031 | 0.06 | — | — | — | 0.01 | — | — | — | — |
| 13 | 0.07 | 1.30 | 1.68 | 0.020 | 0.005 | 0.037 | 0.0039 | 0.04 | — | — | — | 0.01 | 0.12 | — | — | — |
| 14 | 0.08 | 1.29 | 1.53 | 0:021 | 0.005 | 0.032 | 0:0022 | 0:05 | 0.043 | — | — | 0.02 | — | — | — | — |
| 15 | 0.07 | 1.33 | 1.58 | 0.021 | 0.006 | 0.033 | 0.0026 | 0.05 | — | — | 0.09 | 0.02 | — | — | — | — |

TABLE 1A-continued

| | | | | | | | | | | | | | | | | |
|---|---|---|---|---|---|---|---|---|---|---|---|---|---|---|---|---|
| 16 | 0.07 | 1.40 | 1.56 | 0.002 | 0.005 | 0.022 | 0.0029 | 0.05 | — | 0:02 | — | 0.01 | — | — | — | — |
| 17 | 0.09 | 1.30 | 1.65 | 0.026 | 0.010 | 0.028 | 0.0030 | 0.05 | — | — | — | 0.02 | — | 0.03 | — | — |
| 18 | 0.07 | 1.37 | 1.62 | 0.008 | 0.006 | 0.035 | 0.0025 | 0.04 | — | — | — | 0.02 | — | — | 0.0017 | — |
| 19 | 0.08 | 1.39 | 1.64 | 0.011 | 0.011 | 0.034 | 0.0025 | 0:04 | — | — | — | 0.01 | — | — | — | — |
| 20 | 0.09 | 1.27 | 1.60 | 0.001 | 0.008 | 0.039 | 0.0030 | 0.05 | — | — | — | 0.02 | — | — | — | — |
| 21 | 0.09 | 1.23 | 1.69 | 0.027 | 0.010 | 0.031 | 0.0027 | 0.04 | — | — | — | 0.01 | — | — | — | 0.02 |
| 22 | 0.08 | 1.32 | 1.67 | 0.003 | 0.005 | 0.034 | 0.0037 | 0.08 | 0.020 | 0.01 | 0:02 | 0.12 | 0.10 | 0.02 | 0 0020 | 0 02 |
| 23 | 0.08 | 1.32 | 1.67 | 0.003 | 0.005 | 0.034 | 0.0037 | 0.04 | 0.020 | 0.01 | 0.02 | 0.12 | 010 | 0.02 | 0.0020 | 0.02 |
| 24 | 0.09 | 1.56 | 2.00 | 0.010 | 0.007 | 0.038 | 0.0031 | 0.14 | — | — | — | 0.04 | — | — | — | — |
| 25 | 0.08 | 1.85 | 2.06 | 0.022 | 0.006 | 0:031 | 0.0024 | 0.33 | — | — | — | 0.04 | — | — | — | — |
| 26 | 0.08 | 0.03 | 1.23 | 0.020 | 0.008 | 0.237 | 0.0030 | 0.30 | 0.023 | — | 0.07 | 0.08 | — | — | 0.0016 | — |
| 27 | 0.07 | 0.05 | 1.29 | 0.025 | 0.008 | 0.313 | 0.0033 | 0.22 | 0.021 | — | 0.07 | 0.06 | — | — | 0.0013 | — |
| 28 | 0.12 | 1.86 | 1.23 | 0.015 | 0.010 | 0.679 | 0.0027 | 0.22 | 0.027 | — | 0:07 | 0.03 | — | — | 0.0018 | — |
| 29 | 0.09 | 1.98 | 1.23 | 0.016 | 0.007 | 0.715 | 0.0032 | 0.37 | 0.012 | — | 0:05 | 0.04 | — | — | 0.0014 | — |
| 30 | 0.05 | 0.86 | 1.47 | 0.015 | 0.005 | 0.032 | 0.0034 | 0.01 | — | — | — | 0.01 | — | — | — | — |

| | Chemical Composition (mass %, remainder: Fe and impurities) | | | | | | | | (mass %) | (–) |
|---|---|---|---|---|---|---|---|---|---|---|
| Steel | Mg | Ca | REM | O | Zr | Co | Zn | Sn | Si + Al | Ni/Cu |
| 1 | — | — | — | — | — | — | — | — | 0.25 | 2.00 |
| 2 | — | — | — | — | — | — | — | — | 0.28 | 3.00 |
| 3 | — | — | — | — | — | — | — | — | 0.87 | 2.00 |
| 4 | — | — | — | — | — | — | — | — | 0.59 | 1.50 |
| 5 | — | — | — | — | — | — | — | — | 0.84 | 2.00: |
| 6 | — | — | — | — | — | — | — | — | 0.96 | 2.00 |
| 7 | — | — | — | — | — | — | — | — | 2.30 | 49.00 |
| 8 | — | — | — | — | — | — | — | — | 1.15 | 0.50 |
| 9 | — | — | — | — | — | — | — | — | 2.21 | 0.50 |
| 10 | — | — | — | — | — | — | — | — | 3.02 | 6.00 |
| 11 | — | — | — | — | — | — | — | — | 2.04 | 7.00 |
| 12 | — | — | — | — | — | — | — | — | 2.97 | 6.00 |
| 13 | — | — | — | — | — | — | — | — | 1.42 | 4.00 |
| 14 | — | — | — | — | — | — | — | — | 1.32 | 2.50 |
| 15 | — | — | — | — | — | — | — | — | 1.36 | 2.50 |
| 16 | — | — | — | — | — | — | — | — | 142 | 5.00 |
| 17 | — | — | — | — | — | — | — | — | 1.33 | 2.50 |
| 18 | — | — | — | — | — | — | — | — | 141 | 2.00 |
| 19 | — | 0.0019 | — | 0.0011 | — | — | — | — | 1.42 | 4.00 |
| 20 | 0.001 | — | — | — | — | — | — | — | 1.30 | 2.50 |
| 21 | — | — | — | — | — | — | — | — | 1.27 | 4.00 |
| 22 | 0.002 | 0.0012 | 0.0010 | 0:0030 | — | — | — | — | 1.35 | 0.67 |
| 23 | 0.002 | 0.0012 | 0.0010 | 0.0030 | — | — | — | — | 135 | 0.33 |
| 24 | — | — | — | — | — | — | — | — | 1.60 | 3.50 |
| 25 | — | — | — | — | — | — | — | — | 1.88 | 8.25 |
| 26 | — | — | — | — | — | — | — | — | 0.27 | 3.75 |
| 27 | — | — | — | — | — | — | — | — | 0.36 | 3.67 |
| 28 | — | 0.0014 | — | 0.0022 | — | — | — | — | 2.54 | 7.33 |
| 29 | — | 0.0019 | — | 0.0028 | — | — | — | — | 2.69 | 9.25 |
| 30 | — | — | — | — | — | — | — | — | 0.89 | 1.00 |

TABLE 1B

| | Chemical Composition (mass %, remainder: Fe and impurities) | | | | | | | | | | | | | | | |
|---|---|---|---|---|---|---|---|---|---|---|---|---|---|---|---|---|
| Steel | C | Si | Mn | P | S | Al | N | Ni | Nb | V | Ti | Cu | Cr | Mo | B | W |
| 31 | 0.06 | 0.01 | 1.42 | 0.008 | 0.001 | 0332 | 0:0020 | 0.01 | 0.010 | — | 0.13 | 0.01 | — | — | — | — |
| 32 | 0.19 | 0.43 | 1.77 | 0.010 | 0:007 | 0.050 | 0.0037 | 0.01 | — | — | — | 0.01 | — | — | — | — |
| 33 | 0.07 | 1.12 | 1.34 | 0.007 | 0.003 | 0.036 | 0.0028 | 0 06 | — | — | — | 0.25 | — | — | — | — |
| 34 | 0.05 | 0.01 | 1.32 | 0.013 | 0.002 | 0.282 | 0 0020 | 0.04 | 0:010 | — | 0.07 | 0.34 | 0:03 | — | — | — |
| 35 | 0.09 | 1.94 | 1.43 | 0.013 | 0:009 | 0.024 | 0.0034 | 0.84 | — | — | — | 0.02 | — | — | — | — |
| 36 | 0.04 | 0.01 | 1.53 | 0.008 | 0.001 | 0.256 | 0.0052 | 0.66 | 0.010 | — | 0.13 | 0.01 | — | — | — | — |
| 37 | 0.14 | 1.98 | 1.23 | 0.016 | 0:007 | 0.715 | 0.0032 | 0.98 | 0.012 | — | 0.01 | 0.04 | — | — | — | — |
| 38 | 0.05 | 0:84 | 1.45 | 0:010 | 0:012 | 0:030 | 0.0026 | 0.02 | — | — | — | 0.01 | — | — | — | — |
| 39 | 0.05 | 0.84 | 1.15 | 0.010 | 0.012 | 0.030 | 0.0026 | 0.02 | — | — | — | 0.01 | — | — | — | — |
| 40 | 0.05 | 0.84 | 1 15 | 0:010 | 0.012 | 0 030 | 0.0020 | 0.02 | — | — | — | 0.01 | — | — | — | — |
| 41 | 0.05 | 0.84 | 1.45 | 0:010 | 0.012 | 0:030 | 0.0026 | 0.02 | — | — | — | 0.01 | — | — | — | — |
| 42 | 0.05 | 0.84 | 1.45 | 0:010 | 0.012 | 0:030 | 0.0026 | 0.02 | — | — | — | 0.01 | — | — | — | — |
| 43 | 0.05 | 0:84 | 1.45 | 0.010 | 0:012 | 0.030 | 0.0026 | 0.02 | — | — | — | 0.01 | — | — | — | — |
| 44 | 0.05 | 0:84 | 1.45 | 0.010 | 0:012 | 0.030 | 0.0026 | 0.02 | — | — | — | 0.01 | — | — | — | — |
| 45 | 0.05 | 0:84 | 1.45 | 0.010 | 0:012 | 0.030 | 0.0026 | 0.02 | — | — | — | 0.01 | — | — | — | — |
| 46 | 0.05 | 0.84 | 1.45 | 0:010 | 0.012 | 0:030 | 0.0026 | 0.02 | — | — | — | 0.01 | — | — | — | — |
| 47 | 0.05 | 0.84 | 1.45 | 0.010 | 0.012 | 0.030 | 0.0026 | 0.02 | — | — | — | 0.01 | — | — | — | — |
| 48 | 0.06 | 0.01 | 1.37 | 0.008 | 0.006 | 0.268 | 0.0055 | 0.06 | 0.019 | — | 0.16 | 0.02 | — | — | — | — |
| 49 | 0.06 | 0:01 | 1.37 | 0:008 | 0:006 | 0:268 | 0.0055 | 0.06 | 0.019 | — | 0.16 | 0.02 | — | — | — | — |
| 50 | 0.06 | 0.01 | 1.37 | 0.008 | 0.006 | 0.268 | 0.0055 | 0.06 | 0.019 | — | 0.16 | 0.02 | — | — | — | — |

TABLE 1B-continued

| | | | | | | | | | | | | | | | | |
|---|---|---|---|---|---|---|---|---|---|---|---|---|---|---|---|---|
| 51 | 0.06 | 0.01 | 1.37 | 0.008 | 0.006 | 0.268 | 0.0055 | 0.06 | 0:019 | — | 0.16 | 0.02 | — | — | — | — |
| 52 | 0.06 | 0:01 | 1.37 | 0:008 | 0:006 | 0:268 | 0.0055 | 0.06 | 0:019 | — | 0.16 | 0.02 | — | — | — | — |
| 53 | 0.06 | 0.01 | 1.37 | 0.008 | 0.006 | 0.268 | 0.0055 | 0.06 | 0.019 | — | 0.16 | 0.02 | — | — | — | — |
| 54 | 0.06 | 0.01 | 1.37 | 0.008 | 0:006 | 0.268 | 0.0055 | 0.06: | 0.019 | — | 0.16 | 0.02 | — | — | — | — |
| 55 | 0.06 | 0:01 | 1.37 | 0.008 | 0:006 | 0.268 | 0.0055 | 0.06 | 0:019 | — | 0:16 | 0.02 | — | — | — | — |
| 56 | 0.06 | 0.01 | 1.37 | 0.008 | 0.006 | 0.268 | 0.0055 | 0.06 | 0.019 | — | 0.16 | 0.02 | — | — | — | — |
| 57 | 0.06 | 0.01 | 1.37 | 0:008 | 0.006 | 0:268 | 0.0055 | 0.06 | 0.019 | — | 0.16 | 0.02 | — | — | — | — |
| 58 | 0.09 | 0.20 | 1.45 | 0:020 | 0.003 | 0:026 | 0:0028 | 0.01 | — | — | — | — | — | — | — | — |
| 59 | 0.05 | 0.84 | 1.45 | 0:010 | 0.012 | 0:030 | 0:0026 | 0.02 | — | — | — | 0.01 | — | — | — | — |
| 60 | 0.05 | 0:84 | 1.45 | 0.010 | 0:012 | 0.030 | 0.0026 | 0.02 | — | — | — | 001 | — | — | — | — |

| | Chemical Composition (mass %, remainder: Fe and impurities) | | | | | | | | (mass %) | (–) |
|---|---|---|---|---|---|---|---|---|---|---|
| Steel | Mg | Ca | REM | O | Zr | Co | Zn | Sn | Si + Al | Ni/Cu |
| 31 | — | — | — | — | — | — | — | — | 0.34 | 1.00 |
| 32 | — | — | — | — | — | — | — | — | 0.48 | 1.00 |
| 33 | — | — | — | — | — | — | — | — | 1.15 | 0.24 |
| 34 | — | 0.0035 | — | 0.0021 | — | — | — | — | 0.29 | 0.12 |
| 35 | — | — | — | — | — | — | — | — | 1.96 | 12.00 |
| 36 | — | 0.0020 | — | 0.0025 | — | — | — | — | 0.26 | 66.00 |
| 37 | — | — | — | — | — | — | — | — | 2.69 | 24.50 |
| 38 | — | — | — | — | — | — | — | — | 0.87 | 2.00 |
| 39 | — | — | — | — | — | — | — | — | 0:87 | 2.00 |
| 40 | — | — | — | — | — | — | — | — | 0.87 | 2.00 |
| 41 | — | — | — | — | — | — | — | — | 0.87 | 2.00 |
| 42 | — | — | — | — | — | — | — | — | 0.87 | 2.00 |
| 43 | — | — | — | — | — | — | — | — | 0.87 | 2.00 |
| 44 | — | — | — | — | — | — | — | — | 0.87 | 2.00 |
| 45 | — | — | — | — | — | — | — | — | 0.87 | 2.00 |
| 46 | — | — | — | — | — | — | — | — | 0.87 | 2.00 |
| 47 | — | — | — | — | — | — | — | — | 0.87 | 2:00 |
| 48 | — | — | — | — | — | — | — | — | 0.28 | 3.00 |
| 49 | — | — | — | — | — | — | — | — | 0.28 | 3.00 |
| 50 | — | — | — | — | — | — | — | — | 0.28 | 3.00 |
| 51 | — | — | — | — | — | — | — | — | 0.28 | 3.00 |
| 52 | — | — | — | — | — | — | — | — | 0.28 | 3:00 |
| 53 | — | — | — | — | — | — | — | — | 0.28 | 3.00 |
| 54 | — | — | — | — | — | — | — | — | 0.28 | 3.00 |
| 55 | — | — | — | — | — | — | — | — | 0.28 | 3.00 |
| 56 | — | — | — | — | — | — | — | — | 0.28 | 3.00 |
| 57 | — | — | — | — | — | — | — | — | 0.28 | 3.00 |
| 58 | — | — | — | — | — | — | — | — | 0.23 | |
| 59 | — | — | — | — | — | — | — | — | 0.87 | 2.00 |
| 60 | — | — | — | — | — | — | — | — | 0.87 | 2.00 |

TABLE 1C

| | Chemical Composition (mass % remainder: Fe and impurities) | | | | | | | | | | | | | | | |
|---|---|---|---|---|---|---|---|---|---|---|---|---|---|---|---|---|
| Steel | C | Si | Mn | P | S | Al | N | Ni | Nb | V | Ti | Cu | Cr | Mo | B | W |
| 61 | 0.06 | 0.01 | 1.37 | 0.008 | 0.006 | 0.268 | 0.0055 | 006 | 0.019 | — | 0.16 | 0.02 | — | — | — | — |
| 62 | 0.06 | 0.01 | 1.37 | 0.008 | 0.006 | 0 268 | 0 0055 | 006 | 0.019 | — | 0.16 | 0.02 | — | — | — | — |
| 63 | 0.08 | 0.49 | 1.35 | 0.012 | 0.003 | 0040 | 0 0032 | 004 | — | — | — | 0.01 | — | — | — | — |
| 64 | 0.08 | 0.48 | 1.35 | 0.012 | 0.003 | 0 030 | 0 0032 | 004 | — | — | — | — | — | — | — | — |
| 65 | 0.07 | 1.12 | 1.34 | 0.007 | 0.003 | 0036 | 0 0028 | 0 06 | — | — | — | 0.02 | — | — | — | — |
| 66 | 0.09 | 0.20 | 1.45 | 0.020 | 0.003 | 0 026 | 0 0028 | 0 04 | — | — | — | — | — | — | — | — |
| 67 | 0.03 | 0.01 | 1.27 | 0.008 | 0.008 | 0 239 | 0 0046 | 0 02 | 0.018 | — | 0.17 | — | — | — | — | — |
| 68 | 0.06 | 0.01 | 1.43 | 0.008 | 0.008 | 0 268 | 0 0051 | 006 | 0.019 | — | 0.16 | — | — | — | — | — |
| 69 | 0.06 | 0.84 | 1.45 | 0.002 | 0.012 | 0.030 | 0.0034 | 0.02 | — | — | — | — | — | — | — | — |
| 70 | 0.09 | 0.20 | 1.45 | 0.020 | 0.003 | 0.026 | 0.0028 | 0.04 | — | — | — | — | — | — | — | — |
| 71 | 0.08 | 0.48 | 1.32 | 0.012 | 0.003 | 0:030 | 0.0032 | 0.04 | — | — | — | — | — | — | — | — |
| 72 | 0.23 | 3.02 | 2 24 | 0.006 | 0.005: | 0:036 | 0.0030 | 006 | — | — | — | 0.01 | — | — | — | — |
| 73 | 0.06 | 0.01 | 1.37 | 0.008 | 0.006 | 0.268 | 0.0055 | 0.06 | 0.019 | — | 0.16 | 0.02 | — | — | — | — |
| 74 | 0.05 | 0.01 | 0.52 | 0.008 | 0.006 | 0.060 | 0.0016 | 0.03 | — | — | — | 0.01 | — | — | — | — |
| 75 | 0.06 | 0.72 | 0.95 | 0.008 | 0.001 | 0:030 | 0.0055. | 0:04 | — | — | — | 0.01 | — | — | — | — |
| 76 | 0.06 | 0.01 | 1.37 | 0.008 | 0.006 | 0.268 | 0.0055 | 0.06 | 0.019 | — | 0.16 | 0.02 | — | — | — | — |
| 77 | 0.06 | 0.01 | 1.37 | 0.008 | 0.006 | 0.268 | 0 0055 | 0.06 | 0.019 | — | 0.16 | 0.02 | — | — | — | — |
| 78 | 0.06 | 0.01 | 1.37 | 0.008 | 0.006 | 0.268 | 0.0055 | 0 06 | 0.019 | — | 0.16 | 0.02 | — | — | — | — |
| 79 | 0.06 | 0.01 | 1.37 | 0.008 | 0.006 | 0:268 | 0.0055 | 0.06 | 0.019 | — | 0.16 | 0.02 | — | — | — | — |
| 80 | 0.06 | 0.01 | 1.37 | 0.008 | 0.006 | 0.268 | 0 0055 | 0.06 | 0.019 | — | .0.16 | 0.02 | — | — | — | — |
| 81 | 0.07 | 1.37 | 1.62 | 0.008 | 0.006 | 0.035 | 0.0025 | 0.04 | — | — | — | 0.02 | — | — | 0.0017 | — |
| 82 | 0.16 | 0.05 | 2.00 | 0.014 | 0.003 | 1.050 | 0.0031 | 0.06 | — | — | — | 0.01 | — | — | — | — |
| 83 | 0.05 | 0.84 | 1.45 | 0.010 | 0.012 | 0.030 | 0.0026 | 0.02 | — | — | — | 0.01. | — | — | — | — |
| 84 | 0.06 | 0.84 | 1.45 | 0.010 | 0.006 | 0.031 | 0.0028 | 0.02 | — | — | — | 0.01 | — | — | — | — |
| 85 | 0.03 | 0.01 | 1.27 | 0.008 | 0:008 | 0.239 | 0.0046 | 0.02 | 0.018 | — | 0.17 | 0.01 | — | — | — | — |

TABLE 1C-continued

| | | | | | | | | | | | | | | | | |
|---|---|---|---|---|---|---|---|---|---|---|---|---|---|---|---|---|
| 86 | 0.06 | 0.01 | 1.37 | 0.008 | 0.006 | 0.268 | 0.0055 | 0.06 | 0.019 | — | 0.16 | 0.02 | — | — | — | — |
| 87 | 0.05 | 0.84 | 1.45 | 0.010 | 0.012 | 0.030 | 0 0026 | 0.02 | — | — | — | 0.01 | — | — | — | — |
| 88 | 0.05 | 0.57 | 1.77 | 0.018 | 0.012 | 0.024 | 00014 | 0.09 | — | — | — | 0.06 | — | — | — | — |

| | Chemical Composition (mass % remainder: Fe and impurities) | | | | | | | | (mass %) | (–) |
|---|---|---|---|---|---|---|---|---|---|---|
| Steel | Mg | Ca | REM | O | Zr | Co | Zn | Sn | Si + Al | Ni/Cu |
| 61 | — | — | — | — | — | — | — | — | 0.28 | 3.00 |
| 62 | — | — | — | — | — | — | — | — | 0.28 | 3.00 |
| 63 | — | — | — | — | — | — | — | — | 0.53 | 4.00 |
| 64 | — | — | — | — | — | — | — | — | 0.51 | |
| 65 | — | — | — | — | — | — | — | — | 1.15 | 3.00 |
| 66 | — | — | — | — | — | — | — | — | 0.23 | 1.00 |
| 67 | — | — | — | — | — | — | — | — | 0.25 | |
| 68 | — | — | — | — | — | — | — | — | 0.28 | |
| 69 | — | — | — | — | — | — | — | — | 0.87 | |
| 70 | — | — | — | — | — | — | — | — | 0.23 | |
| 71 | — | — | — | — | — | — | — | — | 0.51 | |
| 72 | — | — | — | — | — | — | — | — | 3.06 | 6.00 |
| 73 | — | — | — | — | — | — | — | — | 0.28 | 3.00 |
| 74 | — | — | — | — | — | — | — | — | 0.07 | 3.00 |
| 75 | — | — | — | — | — | — | — | — | 0.75: | 3.00 |
| 76 | — | — | — | — | — | — | — | — | 0:28 | 3.00 |
| 77 | — | — | — | — | — | — | — | — | 0.28 | 3.00 |
| 78 | — | — | — | — | — | — | — | — | 0.28 | 3.00 |
| 79 | — | — | — | — | — | — | — | — | 0.28 | 3.00 |
| 80 | — | — | — | — | — | — | — | — | 0.28 | 3.00 |
| 81 | — | — | — | — | — | — | — | — | 1.41 | 2.00 |
| 82 | — | — | — | — | — | — | — | — | 1.10 | 6.00 |
| 83 | — | — | — | — | — | — | — | — | 0.87 | 2.00 |
| 84 | — | — | — | — | — | — | — | — | 0.87 | 2.00 |
| 85 | — | — | — | — | 0.4200 | — | — | — | 0.25 | 2.00: |
| 86 | — | — | — | — | — | 03821 | — | — | 0.28 | 3.00 |
| 87 | — | — | — | — | — | — | 0.2221 | — | 0.87 | 2.00 |
| 88 | — | — | — | — | — | — | — | 0:1112 | 0.59 | 1.50 |

TABLE 2A

| | Manufacturing Method | | | | | | |
|---|---|---|---|---|---|---|---|
| | | | | | Descaling Conditions | | |
| | Heating Conditions | | | | Surface | | Injection Force |
| Steel | Minimum Value of Air Ratio (–) | Maximum Value of Air Ratio (A | Holding Time at 1,100° C. or Higher (min) | Extraction Temperature (° C.) | Temperature of Steel Piece Before Primary Descaling (° C.) | Pressure of Primary Descaling (MPa) | During Primary Descaling (MN/(m · s)) |
| 1 | 1.2 | 1.4 | 152 | 1268 | 1255 | 15 | 624 |
| 2 | 1.2 | 1.4 | 84 | 1263 | 1245 | 15 | 53 |
| 3 | 1.1 | 1.3 | 72 | 1268 | 1247 | 15 | 559 |
| 4 | 1.2 | 1.4 | 104 | 1205 | 1182 | 15 | 166 |
| 5 | 1.3 | 1.5 | 79 | 1180 | 1170 | 15 | 696 |
| 6 | 0.9 | 1.1 | 104 | 1195 | 1177 | 15 | 580 |
| 7 | 1.1 | 1.3 | 118 | 1196 | 1184 | 15 | 104 |
| 8 | 1.1 | 1.3 | 114 | 1184 | 1176 | 15 | 233 |
| 9 | 1.1 | 1.3 | 76 | 1188 | 1176 | 15 | 668 |
| 10 | 1.1 | 1.3 | 93 | 1190 | 1182 | 15 | 664 |
| 11 | 1.3 | 1.5 | 77 | 1185 | 1179 | 15 | 504 |
| 12 | 0.9 | 1.1 | 159 | 1268 | 1258 | 15 | 333 |
| 13 | 1.4 | 1.5 | 137 | 1263 | 1258 | 15 | 673 |
| 14 | 1.4 | 1.5 | 122 | 1241 | 1221 | 15 | 303 |
| 15 | 1.2 | 1.4 | 132 | 1251 | 1230 | 15 | 460 |
| 16 | 1.0 | 1.2 | 129 | 1237 | 1213 | 15 | 638 |
| 17 | 1.0 | 1.2 | 96 | 1214 | 1194 | 15 | 407 |
| 18 | 1.3 | 1.5 | 240 | 1257 | 1234 | 15 | 625 |
| 19 | 1.2 | 1.4 | 114 | 1248 | 1233 | 15 | 448 |
| 20 | 1.1 | 1.3 | 60 | 1233 | 1208 | 15 | 500 |
| 21 | 1.3 | 1.5 | 118 | 1220 | 1205. | 15 | 173 |
| 22 | 1.2 | 1.4 | 133 | 1225 | 1205 | 15 | 675 |
| 23 | 1.2 | 1.4 | 133 | 1225 | 1205 | 15 | 643 |
| 24 | 1.4 | 1.5 | 129 | 1255 | 1242 | 15 | 566 |
| 25 | 1.0 | 1.2 | 121 | 1256 | 1235 | 15 | 146 |
| 26 | 1.4 | 1.5 | 79 | 1222 | 1198 | 15 | 108 |

TABLE 2A-continued

| | | | | | | | |
|---|---|---|---|---|---|---|---|
| 27 | 1.1 | 1.3 | 139 | 1263 | 1253 | 15 | 393 |
| 28 | 1.3 | 1.5 | 119 | 1246 | 1230 | 15 | 666 |
| 29 | 1.3 | 1.5 | 183 | 1266 | 1257 | 15 | 323 |
| 30 | 1.1 | 1.3 | 122 | 1250 | 1233 | 15 | 397 |

| | Manufacturing Method | | | | |
|---|---|---|---|---|---|
| | Descaling Conditions | | | | |
| Steel | Pressure of Secondary Descaling (MPa) | Injection Force During Secondary Descaling (MN/(m · s)) | Longest Time for Holding Surface Temperature at 1,100° C. or Higher After Completion of Descaling (sec) | Total Time for Holding Surface Temperature at 1,100° C. or Higher After Completion of Descaling (sec) | Minimum Surface Temperature of Steel Piece During Period of Time from Descaling to Rolling (° C.) |
| 1 | 15 | 187 | 36 | 40 | 1201 |
| 2 | — | — | 31 | 31 | 1211 |
| 3 | 15 | 595 | 22 | 37 | 1214 |
| 4 | 15 | 100 | 30 | 33 | 1137 |
| 5 | 15 | 626 | 39 | 59 | 1112 |
| 6 | 15 | 570 | 24 | 38 | 1141 |
| 7 | 15 | 62 | 33 | 36 | 1135 |
| 8 | 15 | 280 | 23 | 35 | 1142 |
| 9 | 15 | 601 | 36 | 47 | 1122 |
| 10 | 15 | 563 | 29 | 41 | 1139 |
| 11 | 15 | 403 | 56 | 62 | 1123 |
| 12 | 15 | 366 | 48 | 62 | 1186 |
| 13 | 15 | 440 | 55 | 66 | 1176 |
| 14 | 15 | 182 | 55 | 61 | 1139 |
| 15 | 15 | 666 | 32 | 48 | 1182 |
| 16 | 15 | 287 | 55 | 58 | 1131 |
| 17 | 15 | 610 | 37 | 59 | 1139 |
| 18 | 15 | 187 | 34 | 37 | 1183 |
| 19 | 15 | 462 | 39 | 70 | 1175 |
| 20 | 15 | 300 | 35 | 39 | 1156 |
| 21 | 15 | 225 | 22 | 33 | 1172 |
| 22 | 15 | 442 | 54 | 65 | 1124 |
| 23 | 15 | 386 | 53 | 58 | 1123 |
| 24 | 15 | 510 | 60 | 90 | 1152 |
| 25 | 15 | 218 | 47 | 75 | 1165 |
| 26 | 15 | 65 | 48 | 53 | 1126 |
| 27 | 15 | 471 | 28 | 42 | 1211 |
| 28 | 15 | 600 | 53 | 69 | 1151 |
| 29 | 15 | 420 | 41 | 57 | 1196 |
| 30 | 15 | 318 | 28 | 31 | 1191 |

TABLE 2B

| | Manufacturing Method | | | | | | | |
|---|---|---|---|---|---|---|---|---|
| | Heating Conditions | | | | Descaling Conditions | | | |
| Steel | Minimum Value of Air Ratio (–) | Maximinn Value of Air Ratio (–) | Holding Time at 1.100° C. or Higher (min) | Extraction Temperature (° C.) | Surface Temperature of Steel Piece Before Primary Descaling (° C.) | Pressure of Primary Descaling (MPa) | Injection Force During Primary Descaling (MN/(m · s) | Pressure of Secondary Descaling (MPa) |
| 31 | 1.1 | 1.3 | 224 | 1225 | 1215 | 15 | 340 | 15 |
| 32 | 1.1 | 1.3 | 162 | 1224 | 1219 | 15 | 494 | 15 |
| 33 | 1.1 | 1.3 | 119 | 1267 | 1247 | 15 | 534 | 15 |
| 34 | 1.1 | 1.3 | 166 | 1262 | 1241 | 15 | 69 | — |
| 35 | 1.1 | 1.3 | 103 | 1238 | 1218 | 15 | 337 | 15 |
| 36 | 1.1 | 1.3 | 100 | 1264 | 1254 | 15 | 355 | 15 |
| 37 | 1.1 | 1.3 | 159 | 1234 | 1216 | 15 | 474 | 15 |
| 38 | 0.6 | 0.8 | 72 | 1256 | 1240 | 15 | 597 | 15 |
| 39 | 1.1 | 1.3 | 56 | 1240 | 1216 | 15 | 532 | 15 |
| 40 | 1.1 | 1.3 | 90 | 1176 | 1169 | 15 | 250 | 15 |
| 41 | 1.2 | 1.4 | 125 | 1232 | 1162 | 15 | 446 | 15 |
| 42 | 1.1 | 1.3 | 120 | 1189 | 1180 | 3 | 48 | — |
| 43 | 1.1 | 1.3 | 123 | 1221 | 1196 | 5 | 282 | — |
| 44 | 1.1 | 1.3 | 125 | 1224 | 1210 | 50 | 522 | — |
| 45 | 1.1 | 1.3 | 124 | 1246 | 1224 | 90 | 702 | — |
| 46 | 1.1 | 1.3 | 132 | 1242 | 122.1 | 15 | 319 | — |
| 47 | 1.0 | 1.2 | 131 | 1231 | 1210 | 15 | 65 | — |
| 48 | 0.6 | 0.8 | 121 | 1256 | 1236 | 15 | 178 | — |

TABLE 2B-continued

| | | | | | | | | |
|---|---|---|---|---|---|---|---|---|
| 49 | 1.1 | 1.3 | 56 | 1240 | 1216 | 15 | 185 | — |
| 50 | 1.1 | 1.3 | 90 | 1176 | 1165 | 15 | 671 | — |
| 51 | 1.2 | 1.4 | 125 | 1232 | 1162 | 15 | 672 | — |
| 52 | 1.1 | 1.3 | 120 | 1189 | 1180 | 3 | 32 | — |
| 53 | 1.1 | 1.3 | 123 | 1221 | 1196 | 5 | 397 | — |
| 54 | 1.1 | 1.3 | 125 | 1224 | 1210 | 50 | 487 | — |
| 55 | 1.1 | 1.3 | 124 | 1246 | 1224 | 90 | 912 | — |
| 56 | 1.1 | 1.3 | 132 | 1242 | 1221 | 15 | 378 | — |
| 57 | 1.0 | 1.2 | 131 | 1231 | 1210 | 15 | 369 | — |
| 58 | 1.1 | 1.3 | 138 | 1235 | 1211 | 15 | 570 | — |
| 59 | 1.6 | 1.8 | 74 | 1260 | 1234 | 15 | 616 | — |
| 60 | 1.1 | 1.3 | 246 | 1238 | 1226 | 15 | 651 | — |

| | Manufacturing Method | | | |
|---|---|---|---|---|
| | Descaling Conditions | | | |
| Steel | Injection Force During Secondary Descaling (MN/(m · s)) | Longest Time for Holding Surface Temperature at 1,100° C. or Higher After Completion. of Descaling ( sec) | Total Time for Holding Surface Temperature at 1,100° C. or Higher After Completion of Descaling (sec) | Minimum Surface Temperature of Steel Piece During Period of Time from Descaling to Rolling (° C.) |
| 31 | 383 | 44 | 57 | 1149 |
| 32 | 544 | 38 | 46 | 1162 |
| 33 | 321 | 59 | 65 | 1159 |
| 34 | — | 40 | 40 | 1181 |
| 35 | 152 | 25 | 26 | 1181 |
| 36 | 533 | 59 | 94 | 1166 |
| 37 | 142 | 34 | 37 | 1165 |
| 38 | 465 | 36 | 65 | 1186 |
| 39 | 425 | 60 | 66 | 1126: |
| 40 | 275 | 42 | 55 | 1107 |
| 41 | 490 | 30 | 36 | 1117 |
| 42 | — | 25 | 25 | 1143 |
| 43 | — | 64 | 64 | 1100 |
| 44 | — | 72 | 72 | 1102 |
| 45 | — | 40 | 40 | 1164 |
| 46 | — | 12 | 12 | 1203 |
| 47 | — | 270 | 270 | 1000 |
| 48 | — | 40 | 40 | 1176 |
| 49 | — | 60 | 60 | 1126 |
| 50 | — | 82 | 82 | 1104: |
| 51 | — | 64 | 64 | 1111 |
| 52 | — | 72 | 72 | 1122 |
| 53 | — | 64 | 64 | 1100 |
| 54 | — | 72 | 72 | 1102 |
| 55 | — | 40 | 40 | 1164 |
| 56 | — | 12 | 12 | 1000 |
| 57 | — | 270 | 270 | 1021 |
| 58 | — | 33 | 33 | 1162 |
| 59 | — | 38 | 38 | 1177 |
| 60 | — | 62 | 62 | 1133 |

TABLE 2C

| | Manufacturing Method | | | | | | | |
|---|---|---|---|---|---|---|---|---|
| | Heating Conditions | | | | Descaling Conditions | | | |
| Steel | Minimum Value of Air Ratio (–) | Maximinn Value of Air Ratio (–) | Holding Time at 1.100° C. or Higher (min) | Extraction Temperature (° C.) | Surface Temperature of Steel Piece Before Primary Descaling (° C.) | Pressure of Primary Descaling (MPa) | Injection Force During Primary Descaling (MN/(m · s) | Pressure of Secondary Descaling (MPa) |
| 61 | 1.6 | 1.8 | 124 | 1260 | 1240 | 15 | 547 | — |
| 62 | 1.1 | 1.3 | 246 | 1238 | 1226 | 15 | 209 | — |
| 63 | 0.9 | 1.1 | 104 | 1200 | 1188 | 15 | 399 | — |
| 64 | 0.9 | 1.1 | 126 | 1196 | 1184 | 15 | 306 | — |
| 65 | 1.1 | 1.3 | 119 | 1267 | 1247 | 15 | 108 | — |
| 66 | 1.1 | 1.3 | 138 | 1235 | 1211 | 15 | 531 | — |
| 67 | 1.2 | 1.4 | 152 | 1268 | 1255 | 15 | 561 | — |
| 68 | 1.2 | 1.4 | 84 | 1269 | 1243 | 15 | 168 | — |
| 69 | 1.1 | 1.3 | 72 | 1268 | 1246 | 15 | 524 | — |
| 70 | 1.1 | 1.3 | 136 | 1226 | 1201 | 15 | 582 | — |

TABLE 2C-continued

| | | | | | | | | |
|---|---|---|---|---|---|---|---|---|
| 71 | 0.9 | 1.1 | 128 | 1196 | 1184 | 15 | 105 | — |
| 72 | 1.1 | 1.3 | 93 | 1190 | 1182 | 15 | 234 | — |
| 73 | 1.2 | 1.4 | 84 | 1263 | 1245 | 15 | 497 | 15 |
| 74 | 1.2 | 1.4 | 84 | 1210 | 1190 | 15 | 665 | 15 |
| 75 | 1.2 | 14 | 84 | 1224 | 1195 | 15 | 697 | — |
| 76 | 1.2 | 1.3 | 80 | 1256 | 1244 | 30 | 108 | — |
| 77 | 1.2 | 1.3 | 104 | 1267 | 1242 | 40 | 665 | — |
| 78 | 1.2 | 14 | 86 | 1245 | 1221 | 15 | 40 | — |
| 79 | 1.2 | 1.4 | 96 | 1268 | 1251 | 15 | 860 | — |
| 80 | 1.1 | 1.3 | 72 | 1210 | 1201 | 90 | 699 | — |
| 81 | 1.3 | 1.5 | 200 | 1260 | 1245 | 3 | 79 | — |
| 82 | 0.9 | 1.2 | 145 | 1246 | 1236 | 15 | 75 | — |
| 83 | 1.1 | 1.4 | 126 | 1234 | 1224 | 15 | 522 | 60 |
| 84 | 1.1 | 1.4 | 130 | 1234 | 1228 | 15 | 76 | 15 |
| 85 | 1.2 | 14 | 142 | 1255 | 1241 | 15 | 512 | 15 |
| 86 | 1.2 | 1.4 | 74 | 1261 | 1222 | 15 | 53 | — |
| 87 | 1.1 | 1.3 | 76 | 1262 | 1247 | 20 | 426 | 15 |
| 88 | 1.2 | 1.4 | 112 | 1204 | 1176 | 20 | 186 | 15 |

| | Manufacturing Method | | | |
|---|---|---|---|---|
| | Descaling Conditions | | | |
| Steel | Injection Force During Secondary Descaling (MN/(m · s)) | Longest Time for Holding Surface Temperature at 1,100° C. or Higher After Completion. of Descaling ( sec) | Total Time for Holding Surface Temperature at 1,100° C. or Higher After Completion of Descaling (sec) | Minimum Surface Temperature of Steel Piece During Period of Time from Descaling to Rolling (° C.) |
| 61 | — | 42 | 42 | 1177 |
| 62 | — | 62 | 62 | 1133 |
| 63 | — | 33 | 33 | 1139 |
| 64 | — | 31 | 31 | 1145 |
| 65 | — | 59 | 59 | 1159 |
| 66 | — | 33 | 33 | 1162 |
| 67 | — | 36 | 36 | 1201 |
| 68 | — | 36 | 36 | 1211 |
| 69 | — | 38 | 38 | 1226 |
| 70 | — | 21 | 21 | 1186 |
| 71 | — | 26 | 26 | 1160 |
| 72 | — | 29 | 29 | 1139 |
| 73 | 223 | 21 | 35 | 1211 |
| 74 | 465 | 41 | 45 | 1110 |
| 75 | — | 31 | 31 | 1141 |
| 76 | — | 42 | 42 | 1189 |
| 77 | — | 60 | 60 | 1186 |
| 78 | — | 31 | 31 | 1186 |
| 79 | — | 42 | 42 | 1124 |
| 80 | — | 60 | 61 | 1101 |
| 81 | — | 72 | 72 | 1172 |
| 82 | — | 192 | 192 | 1102 |
| 83 | 601 | 72 | 82 | 1102 |
| 84 | 72 | 18 | 35 | 1176 |
| 85 | 160 | 46 | 46 | 1267 |
| 86 | — | 41 | 41 | 1204 |
| 87 | 121 | 41 | 65 | 1200 |
| 88 | 161 | 30 | 61 | 1111 |

The obtained hot-rolled steel sheet was pickled under conditions of 30 to 60 seconds using a 1 to 10 wt % (weight %) hydrochloric acid solution at a temperature of 20° C. to 95° C., and EPMA analysis targeted at an element having an atomic number equal to or more than that of B was performed in a region of 250 μm×250 μm on the surface after the pickling at a measurement pitch of 1 μm under the above-described conditions to obtain the percentage of measurement points having a Ni content of 0.5 mass % or more and the percentage of measurement points having an oxygen content of 0.5 mass % or more when the total mass of the element having an atomic number equal to or more than that of B was 100%, and to obtain the average interval between the regions having a Ni content of 0.5 mass % or more.

The results are shown in the column of surface structure in Tables 3A to 3C.

In Tables 3A to 3C, an average interval of ≤1 (μm) between the regions where the Ni content of the pickled surface is 0.5 mass % or more shows that the average interval is smaller than the measurement pitch and cannot be measured.

In addition, the tensile strength of the obtained hot-rolled steel sheet was evaluated.

The tensile strength (TS) was measured according to JIS Z 2241: 2011 using a test piece No. 5 of JIS Z 2241: 2011 collected with a direction (sheet width direction) orthogonal to the rolling direction as a longitudinal direction, at a position either W/4 or 3W/4 away from one end of the steel sheet in the sheet width direction where W is a sheet width.

The tensile strength (TS) result is shown in Tables 3A to 3C together with the sheet thickness of the hot-rolled steel sheet.

In addition, the obtained hot-rolled steel sheet was pickled under the pickling conditions described above. Then, under the following conditions assuming a chemical conversion treatment liquid deteriorated due to continuous use or the like, a chemical conversion treatment was performed on the hot-rolled steel sheet pickled as described above, and the chemical convertibility was evaluated. The effects of the present steel sheet can be exhibited regardless of a zinc phosphate-based chemical conversion treatment liquid, and for example, the evaluation was performed under the following conditions.

(1) Degreasing Treatment:

Chemical manufactured by Nippon Paint Holdings Co., Ltd.: SD400

Temperature of Chemical: 42° C.

Spraying Time of Chemical on Surface of Test Piece: 120 seconds (2) Surface Adjustment Treatment:

Chemical manufactured by Nippon Paint Holdings Co., Ltd.: 5N-10

Immersion Time in Chemical: 20 seconds (3) Chemical Conversion Treatment:

Chemical manufactured by Nippon Paint Holdings Co., Ltd.: SUIRFTDINE DP4000

Temperature of Chemical (chemical conversion bath temperature): 35° C.

Bath Time: 60 seconds

Free Acidity: 0.5 pt

Total Acidity (TA): 25 pt

Accelerator: 2.0 pt (4) Water Washing Treatment:

City Water (spraying)

Temperature of City Water: 25° C.

Water Washing Time: 30 seconds (5) Pure Water Washing Treatment:

Deionized Water (spraying)

Temperature of Deionized Water: 25° C.

Pure Water Washing Time: 30 seconds

Here, the free acidity is defined in such a manner that in a case where 3 drops of bromophenol blue are added to 10 ml of a chemical conversion treatment liquid and neutralization titration is carried out using 0.1 N sodium hydroxide until the color changes from a yellowish green color to a bluish green color, 1 ml of the 0.1 N sodium hydroxide required for this case is indicated as 1 pt. In addition, the total acidity is defined in such a manner that in a case where 3 drops of phenolphthalein are added to 10 ml of a chemical conversion treatment liquid and neutralization titration is carried out using 0.1 N sodium hydroxide until the color changes from colorless to a pink color, 1 ml of the 0.1 N sodium hydroxide required for this case is indicated as 1 pt.

The chemical convertibility improvement effect in the present steel sheet can also be exhibited with chemical conversion treatment liquids of other model numbers or other companies, regardless of whether the chemical conversion treatment liquid is used under the conditions of the chemical conversion treatment shown above.

In a case where no transparency was seen and the size of chemical conversion crystals was 10 μm or less as a result of the chemical conversion treatment, the steel sheet was judged to have excellent chemical convertibility. This is because: regardless of whether the chemical conversion treatment has been performed, the adhesion between the steel sheet and the lacquer is reduced in a state in which the base metal sheet is exposed, that is, transparency is generated; and the coating adhesion is reduced due to the cohesive fracture of the zinc phosphate film itself in a case where the size of chemical conversion crystals after the chemical conversion treatment is greater than 10 μm.

In a case where the size of chemical conversion crystals is 10 μm or less, the adhesion between the lacquer and the steel sheet and the corrosion resistance after peeling of the coating film are improved, and in a case where the size of chemical conversion crystals is 5 μm or less, the adhesion between the lacquer and the steel sheet and the corrosion resistance after peeling of the coating film are further improved. In the examples, steel sheets in which no transparency was generated and the size of chemical conversion crystals was 5 μm or less were evaluated to be A (invention examples), steel sheets in which no transparency was generated and the size of chemical conversion crystals was greater than 5 μm and equal to or less than 10 μm were evaluated to be B (invention examples), and steel sheets in which transparency was generated or the size of chemical conversion crystals was greater than 10 μm even without the generation of transparency were evaluated to be C (comparative examples).

Although not shown in the tables, before the evaluation of the chemical convertibility, EPMA analysis targeted at an element having an atomic number equal to or more than that of B was performed at a measurement pitch of 1 μm on a rectangular region of 10 μm in sheet thickness direction from the surface of the steel sheet×500 μm in sheet width direction in a cross-section of the hot-rolled steel sheet subjected to the chemical conversion treatment in the sheet thickness direction to obtain the percentage of measurement points having a Ni content of 0.5 mass % or more when the total mass of the element having an atomic number equal to or more than that of B was 100%, and the result thereof was the same as the percentage of measurement points having a Ni content of 0.5 mass % or more, measured in a region of 250 μm×250 μm on the surface after pickling and before the chemical conversion treatment.

A SEM was used for observing transparency. Specifically, the presence or absence of the transparency was investigated by confirming whether there is a surface in which the base metal sheet is exposed in a region of 250 μm×250 μm in each of three visual fields of both sides of the steel sheet after the chemical conversion treatment by the SEM.

Similarly, regarding the size of chemical conversion crystals, the grain diameters (diameters) of chemical conversion crystals were obtained in a region of 250 μm×250 μm in the SEM observation performed as described above, and the average of the grain diameters (diameters) of chemical conversion crystals was defined as the size of chemical conversion crystals.

The worst result among those obtained in 6 visual fields observed is shown in the column of properties of the chemical conversion-treated product in Tables 3A to 3C.

TABLE 3A

| Steel | Surface Structure: Percentage of Measurement Points at Which Ni content of Pickled Surface is 0.5 mass % or more (%) | Surface Structure: Percemage of Measurement Points at Which Oxygen Content of Pickled Surface is 0.5 mass % or more (%) | Surface Structure: Average Interval Between Regions Where Ni Content of Pickled Surface is 0.5 mass % or more (μm) | Sheet Thickness (mm) | TS (MPa) |
|---|---|---|---|---|---|
| 1 | 12 | 15 | 6 | 2.9 | 801 |
| 2 | 26 | 13 | 5 | 2.9 | 821 |
| 3 | 13 | 19 | 5 | 3.6 | 621 |
| 4 | 32 | 27 | 4 | 2.0 | 560 |
| 5 | 12 | 14 | 6 | 3.4 | 542 |
| 6 | 28 | 10 | 4 | 3.2 | 560 |
| 7 | 69 | 26 | 6 | 2.6 | 601 |
| 8 | 13 | 10 | 6 | 2.8 | 612 |
| 9 | 16 | 14 | 4 | 2.1 | 634 |
| 10 | 26 | 25 | 7. | 2.3 | 1121 |
| 11 | 32 | 20 | 5 | 2.4 | 940 |
| 12 | 32 | 25 | 6 | 2.6 | 879 |
| 13 | 28 | 16 | 4 | 4.0 | 621 |
| 14 | 32 | 15: | 5 | 2.0 | 653 |
| 15 | 36 | 20 | 6 | 1.8 | 792 |
| 16 | 38 | 16 | 8 | 10.0 | 692 |
| 17 | 32 | 29 | 4 | 2.6 | 682 |
| 18 | 33 | 26 | 5 | 2.4 | 692 |
| 19 | 34 | 21 | 6 | 2.8 | 582 |
| 20 | 35 | 13 | 6 | 2.8 | 592 |
| 21 | 39 | 23 | 4 | 1.8 | 642 |
| 22 | 30 | 29: | 6 | 4.0 | 652 |
| 23 | 7 | 32: | 8 | 4.0 | 648 |
| 24 | 56 | 28 | 6 | 2.9 | 782 |
| 25 | 58 | 16 | 5 | 2.4 | 746 |
| 26 | 46 | 23 | 5 | 2.0 | 690 |
| 27 | 40 | 13 | 9 | 2.0 | 694 |
| 28 | 35 | 22 | 3 | 2.4 | 592 |
| 29 | 62 | 21 | 4 | 2.4 | 603 |
| 30 | 8 | 32 | 12 | 2.0 | 546 |

| Steel | Properties of Chemical Conversion-Treated Product: Presence or Absence of transparency | Properties of Chemical Conversion-Treated Product: Size of Chemical Conversion Crystals (μm) | Evaluation | Remarks |
|---|---|---|---|---|
| 1 | Absence | 4 | A | Invention Example |
| 2 | Absence | 4 | A | Invention Example |
| 3 | Absence | 2 | A | Invention Example |
| 4 | Absence | 2 | A | Invention Example |
| 5 | Absence | 3 | A | Invention Example |
| 6 | Absence | 2 | A | Invention Example |
| 7 | Absence | 4 | A | Invention Example |
| 8 | Absence | 3 | A | Invention Example |
| 9 | Absence | 3 | A | Invention Example |
| 10 | Absence | 2 | A | Invention Example |
| 11 | Absence | 3 | A | Invention Example |
| 12 | Absence | 3 | A | Invention Example |
| 13 | Absence | 2 | A | Invention Example |
| 14 | Absence | 2 | A | Invention Example |
| 15 | Absence | 4 | A | Invention Example |
| 16 | Absence | 5 | A | Invention Example |
| 17 | Absence | 2 | A | Invention Example |
| 18 | Absence | 4 | A | Invention Example |
| 19 | Absence | 3 | A | Invention Example |
| 20 | Absence | 2 | A | Invention Example |
| 21 | Absence | 2 | A | Invention Example |
| 22 | Absence | 3 | A | Invention Example |
| 23 | Absence | 11 | C | Comparative Example |
| 24 | Absence | 3 | A | Invention Example |
| 25 | Absence | 3 | A | Invention Example |
| 26 | Absence | 3 | A | Invention Example |
| 27 | Absence | 3 | A | Invention Example |
| 28 | Absence | 2 | A | Invention Example |
| 29 | Absence | 2 | A | Invention Example |
| 30 | Presence | 16 | C | Comparative Example |

TABLE 3B

| Steel | Surface Structure: Percentage of Measurement Points at Which Ni content of Pickled Surface is 0.5 mass % or more (%) | Surface Structure: Percemage of Measurement Points at Which Oxygen Content of Pickled Surface is 0.5 mass % or more (%) | Surface Structure: Average Interval Between Regions Where Ni Content of Pickled Surface is 0.5 mass % or more (μm) | Sheet Thickness (mm) | TS (MPa) |
|---|---|---|---|---|---|
| 31 | 6 | 36 | 14 | 2.9 | 732 |
| 32 | 4 | 38 | 16 | 2.0 | 543 |
| 33 | 9 | 13 | 60 | 2.0 | 642 |
| 34 | 9 | 16 | 50 | 2:0 | 643 |
| 35 | 86 | 18 | <1 | 3:4 | 853 |
| 36 | 75 | 20 | 2 | 2.1 | 562 |
| 37 | 92 | 26 | <1 | 2.6 | 660 |
| 38 | 5 | 19 | 13 | 2:1 | 534 |
| 39 | 6 | 12 | 13 | 2.1 | 562 |
| 40 | 2 | 16 | 12 | 2:1 | 582 |
| 41 | 9 | 42: | 16 | 2.1. | 542 |
| 42 | 8 | 43 | 18 | 2.1 | 572 |
| 43 | 12 | 15 | 6 | 2.1. | 576 |
| 44 | 16 | 16 | 7 | 2.1 | 587 |
| 45 | 17 | 10 | 14 | 2.1 | 594 |
| 46 | 9 | 12 | 11 | 2.1 | 642 |
| 47 | 7 | 42 | 14 | 2:1 | 547 |
| 48 | 6 | 23 | 16 | 1.8 | 492 |
| 49 | 9 | 14 | 15 | 1.8 | 496 |
| 50 | 8 | 24- | 17 | 1.8 | 512 |
| 51 | 8 | 36 | 17 | 1.8 | 535 |
| 52 | 7 | 43 | 22 | 1.8 | 524 |
| 53 | 12 | 16 | 5 | 1.8 | 552 |
| 54 | 14 | 14 | 5 | 1.8 | 531 |
| 55 | 3 | 10 | 16 | 1.6 | 548 |
| 56 | 9 | 12 | 13 | 1.8 | 498 |
| 57 | 8 | 33 | 13 | 2.0 | 516 |
| 58 | 8 | 18 | 13 | 3.6 | 495 |
| 59 | 11 | 30 | 7 | 8:0 | 542 |
| 60 | 12 | 12 | 7 | 4.2 | 572 |

| Steel | Properties of Chemical Conversion-Treated Product: Presence or Absence of transparency | Properties of Chemical Conversion-Treated Product: Size of Chemical Conversion Crystals (μm) | Evaluation | Remarks |
|---|---|---|---|---|
| 31 | Presence | 20 | C | Comparative Example |
| 32 | Presence | 18 | C | Compar ati ve Example |
| 33 | Absence | 14 | C | Comparative Example |
| 34 | Absence | 13 | C | Comparative Example |
| 35 | Presence | 11 | C | Comparative Example |
| 36 | Presence: | 13 | C | Comparative Example |
| 37 | Presence | 16 | C | Comparative Example |
| 38 | Presence | 11 | C | Comparative Example |
| 39 | Presence | 13 | C | Comparative Example |
| 40 | Presence | 11 | C | Comparative Example |
| 41 | Presence | 15 | C | Comparative Example |
| 42 | Presence | 16 | C | Comparative Example |
| 43 | Absence | 4 | A | Invention Example |
| 44 | Absence | 5 | A | Invention Example |
| 45 | Presence | 12 | C | Comparative Example |
| 46 | Presence | 9 | C | Comparative Example |
| 47' | Presence | 12 | C | Comparative Example |
| 48 | Presence | 14 | C | Comparative Example |
| 49 | Presence | 13 | C | Comparative Example |
| 50 | Presence | 15 | C | Comparative Example |
| 51 | Presence | 15 | C | Comparative Example |
| 52 | Presence | 20 | C | Comparative Example |
| 53 | Absence | 3 | A | Invention Example |
| 54 | Absence | 3 | A | Invention Example |
| 55 | Presence | 14 | C | Comparative Example |
| 56 | Presence | 11 | C | Comparative Example |
| 57 | Presence: | 11 | C | Comparative Example |
| 58 | Absence | 11 | C | Comparative Example |
| 59 | Absence | 5 | A | Invention Example |
| 60 | Absence | 4 | A | Invention Example |

TABLE 3C

| Steel | Surface Structure: Percentage of Measurement Points at Which Ni content of Pickled Surface is 0.5 mass % or more (%) | Surface Structure: Percemage of Measurement Points at Which Oxygen Content of Pickled Surface is 0.5 mass % or more (%) | Surface Structure: Average Interval Between Regions Where Ni Content of Pickled Surface is 0.5 mass % or more (μm) | Sheet Thickness (mm) | TS (MPa) |
|---|---|---|---|---|---|
| 61 | 11 | 29 | 7 | 1.8 | 542 |
| 62 | 10 | 28 | 5 | 1.4 | 562 |
| 63 | 28 | 15 | 4 | 1.4 | 492 |
| 64 | 34 | 20 | 7 | 1.6 | 532 |
| 65 | 26 | 13 | 6 | 1.8 | 573 |
| 66 | 34 | 18 | 5 | 1.6 | 476 |
| 67 | 16 | 15 | 5 | 2.6 | 492 |
| 68 | 29 | 14 | 5 | 2.3 | 469 |
| 69 | 28 | 19 | 4 | 2.4 | 542 |
| 70 | 11 | 12 | 12 | 4.4 | 486 |
| 71 | 14 | 21 | 11 | 4.1 | 514 |
| 72 | 26 | 25 | 14 | 1.8 | 1301 |
| 73 | 24 | 11 | 5 | 2.2 | 782 |
| 74 | 26 | 11 | 4 | 1.8 | 402 |
| 75 | 31 | 15 | 3 | 2.6 | 492 |
| 76 | 36 | 15 | 4 | 2.9 | 818 |
| 77 | 42 | 12 | 3 | 3.1 | 809 |
| 78 | 27 | 16 | 11 | 2.9 | 803 |
| 79 | 16 | 8 | 16 | 2.4 | 742 |
| 80 | 9 | 9 | 26 | 2.0 | 501 |
| 81 | 4 | 42 | 21 | 2.3 | 601 |
| 82 | 16 | 25 | 13 | 2.6 | 686 |
| 83 | 9 | 12 | 19 | 2.0 | 596 |
| 84 | 22 | 26 | 11 | 2.8 | 572 |
| 85 | 16 | 14 | 4 | 3.2 | 832 |
| 86 | 24 | 11 | 5 | 2.6 | 801 |
| 87 | 29 | 26 | 6 | 3.4 | 601 |
| 88 | 34 | 30 | 9 | 1.9 | 581 |

| Properties of Chemical Conversion-Treated Product: Presence or Absence of transparency | Properties of Chemical Conversion-Treated Product: Size of Chemical Conversion Crystals (μm) | Evaluation | Remarks |
|---|---|---|---|
| Absence | 3 | A | Invention Example |
| Absence | 3 | A | Invention Example |
| Absence | 3 | A | Invention Example |
| Absence | 2 | A | Invention Example |
| Absence | 4 | A | Invention Example |
| Absence | 2 | A | Invention Example |
| Absence | 3 | A | Invention Example |
| Absence | 3 | A | Invention Example |
| Absence | 2 | A | Invention Example |
| Absence | 8 | B | Invention Example |
| Absence | 9 | B | Invention Example |
| Presence | 20 | C | Comparative Example |
| Absence | 3 | A | Invention Example |
| Absence | 2 | A | Invention Example |
| Absence | 3 | A | Invention Example |
| Absence | 5' | A | Invention Example |
| Absence | 4 | A | Invention Example |
| Absence | 8 | B | Invention Example |
| Absence | 7 | B | Invention Example |
| Presence | 11 | C | Comparative Example |
| Presence | 15 | C | Comparative Example |
| Absence | 6 | B | Invention Example |
| Presence | 8 | C | Comparative Example |
| Absence | 6 | B | Invention Example |
| Absence | 4 | A | Invention Example |
| Absence | 2 | A | Invention Example |
| Absence | 3 | A | Invention Example |
| Absence | 4 | A | Invention Example |

As shown in Tables 1A to 1C and 3A to 3C, in all the invention examples having a chemical composition within the range of the present invention, in which the percentage of measurement points at which the Ni content of the surface was 0.5 mass % or more was 10% to 70%, no transparency was generated, the size of chemical conversion crystals was 10 μm or less, and the chemical convertibility was excellent.

In the comparative examples in which any one or more of the chemical compositions and the percentage of measurement points at which the Ni content of the surface was 0.5 mass % or more was out of the range of the present invention, transparency was generated or the size of chemical conversion crystals was greater than 10 μm, so that the chemical convertibility was not sufficient.

INDUSTRIAL APPLICABILITY

According to the present invention, it is possible to obtain a hot-rolled steel sheet having excellent chemical convertibility and a method for manufacturing the hot-rolled steel sheet. In the hot-rolled steel sheet of the present invention, even in a case where the conditions of a chemical conversion treatment vary, a good chemical conversion film can be obtained. Accordingly, the present invention has high industrial applicability.

BRIEF DESCRIPTION OF THE REFERENCE SYMBOLS

1: base metal sheet
2: scale
3: oxides of Si, Al, and the like or concentrated layers of Mn, Cu, and the like
4: Ni-concentrated layer
5: chemical conversion crystals

What is claimed is:

1. A hot-rolled steel sheet comprising, as a chemical composition, by mass %:
C: 0.01% to 0.30%;
Si: 0.01% to 3.00%;
Mn: 0.20% to 3.00%;
P: 0.030% or less;
S: 0.030% or less;
Al: 0.001% to 2.000%;
N: 0.0100% or less;
Ni: 0.02% to 0.50%;
Nb: 0% to 0.060%;
V: 0% to 0.20%;
Ti: 0% to 0.20%;
Cu: 0% to 0.20%;
Cr: 0% to 0.20%;
Mo: 0% to 1.00%;
B: 0% to 0.0020%;
W: 0% to 0.50%;
Mg: 0% to 0.010%;
Ca: 0% to 0.0100%;
REM: 0% to 0.0100%;
O: 0% to 0.0100%;
Zr: 0% to 0.500%;
Co: 0% to 0.500%;
Zn: 0% to 0.500%;
Sn: 0% to 0.500%; and
a remainder consisting of Fe and impurities,
wherein among measurement points at which elemental analysis is performed at a measurement pitch of 1 μm using an Electron Probe Micro Analyzer in a region of 250 μm×250 μm on a surface, a percentage of measurement points having a Ni content of 0.5 mass % or more is 10% to 70%.

2. The hot-rolled steel sheet according to claim 1, wherein the chemical composition contains one or two or more selected from:
Nb: 0.003% to 0.060%,
V: 0.01% to 0.20%,
Ti: 0.01% to 0.20%,
Cu: 0.01% to 0.20%,
Cr: 0.01% to 0.20%,
Mo: 0.01% to 1.00%,
B: 0.0005% to 0.0020%,
W: 0.01% to 0.50%,
Mg: 0.001% to 0.010%,
Ca: 0.0010% to 0.0100%,
REM: 0.0010% to 0.0100%, and
O: 0.0005% to 0.0100%.

3. The hot-rolled steel sheet according to claim 2, wherein the chemical composition contains
Si: 0.50% to 3.00%.

4. The hot-rolled steel sheet according to claim 2, wherein the chemical composition contains
Si: 0.01% or more and less than 0.50%, and
Al: 0.050% to 2.000%.

5. The hot-rolled steel sheet according to claim 2, wherein the chemical composition contains
Si: 0.01% or more and less than 0.50%, and
Al: 0.001% or more and less than 0.050%, and
a total of Si and Al is 0.50% or more and less than 0.55%.

6. The hot-rolled steel sheet according to claim 3, wherein among the measurement points at which the elemental analysis is performed on the surface, a percentage of measurement points having an O content of 0.5 mass % or more is 30% or less.

7. The hot-rolled steel sheet according to claim 4, wherein among the measurement points at which the elemental analysis is performed on the surface, a percentage of measurement points having an O content of 0.5 mass % or more is 30% or less.

8. The hot-rolled steel sheet according to claim 5, wherein among the measurement points at which the elemental analysis is performed on the surface, a percentage of measurement points having an O content of 0.5 mass % or more is 30% or less.

9. The hot-rolled steel sheet according to claim 1, wherein the chemical composition contains
Cu: 0.01% to 0.20%, and
Ni/Cu is 0.50 or more.

10. The hot-rolled steel sheet according to claim 1, wherein among the measurement points at which the elemental analysis is performed on the surface, an average interval between the measurement points having a Ni content of 0.5 mass % or more is 3 to 10 μm.

11. The hot-rolled steel sheet according to claim 1, wherein the surface has a rust preventive oil film.

12. The hot-rolled steel sheet according to claim 1, wherein the surface has a chemical conversion film.

13. The hot-rolled steel sheet according to claim 2, wherein the chemical composition contains
Cu: 0.01% to 0.20%, and
Ni/Cu is 0.50 or more.

14. The hot-rolled steel sheet according to claim 3, wherein the chemical composition contains
Cu: 0.01% to 0.20%, and
Ni/Cu is 0.50 or more.

15. The hot-rolled steel sheet according to claim 4, wherein the chemical composition contains
Cu: 0.01% to 0.20%, and
Ni/Cu is 0.50 or more.

16. The hot-rolled steel sheet according to claim 5, wherein the chemical composition contains
Cu: 0.01% to 0.20%, and
Ni/Cu is 0.50 or more.

17. The hot-rolled steel sheet according to claim 6, wherein the chemical composition contains
Cu: 0.01% to 0.20%, and
Ni/Cu is 0.50 or more.

18. The hot-rolled steel sheet according to claim 7, wherein the chemical composition contains
Cu: 0.01% to 0.20%, and
Ni/Cu is 0.50 or more.

19. A method for manufacturing a hot-rolled steel sheet comprising:
heating a steel piece having the chemical composition according to claim 1 in a heating furnace;
descaling the heated steel piece; and
hot-rolling the steel piece after the descaling to obtain a hot-rolled steel sheet,
wherein in the heating,
after a surface temperature of the steel piece reaches 1,100° C. or higher, the steel piece is held for 60 minutes or longer under an atmosphere having an air ratio of 0.9 or more, and
an extraction temperature is 1,180° C. or higher, and in the descaling,
the steel piece of which the surface temperature is 1,170° C. or higher is descaled at least once with an injection pressure of 5 to 50 MPa, and
the surface temperature of the steel piece is held at 1,100° C. or higher for 20 to 240 seconds after completion of the descaling.

20. A hot-rolled steel sheet comprising, as a chemical composition, by mass %:
C: 0.01% to 0.30%;
Si: 0.01% to 3.00%;
Mn: 0.20% to 3.00%;
P: 0.030% or less;
S: 0.030% or less;
Al: 0.001% to 2.000%;
N: 0.0100% or less;
Ni: 0.02% to 0.50%;
Nb: 0% to 0.060%;
V: 0% to 0.20%;
Ti: 0% to 0.20%;
Cu: 0% to 0.20%;
Cr: 0% to 0.20%;
Mo: 0% to 1.00%;
B: 0% to 0.0020%;
W: 0% to 0.50%;
Mg: 0% to 0.010%;
Ca: 0% to 0.0100%;
REM: 0% to 0.0100%;
O: 0% to 0.0100%;
Zr: 0% to 0.500%;
Co: 0% to 0.500%;
Zn: 0% to 0.500%;
Sn: 0% to 0.500%; and
a remainder comprising Fe and impurities,
wherein among measurement points at which elemental analysis is performed at a measurement pitch of 1 μm using an Electron Probe Micro Analyzer in a region of 250 μm×250 μm on a surface, a percentage of measurement points having a Ni content of 0.5 mass % or more is 10% to 70%.

* * * * *